US005300952A

United States Patent [19]

Wada et al.

[11] Patent Number: 5,300,952

[45] Date of Patent: Apr. 5, 1994

[54] THERMAL IMAGE FORMING EQUIPMENT FORMS IMAGE DIRECTLY ON IMAGE CARRIER OR PAPER SHEET

[75] Inventors: Takeo Wada, Tokyo; Makoto Obu, Yokohama; Toshiyuki Kawanishi, Numazu; Noriyoshi Tarumi, Tokyo; Masato Igarashi, Numazu; Takashi Mori, Tokyo; Katsuaki Miyawaki, Yokohama; Minoru Suzuki, Yokohama, all of Japan

[73] Assignee: Ricoh Company, Ltd., Tokyo, Japan

[21] Appl. No.: 782,609

[22] Filed: Oct. 25, 1991

[30] Foreign Application Priority Data

Oct. 25, 1990 [JP] Japan ..... 2-288060
Oct. 25, 1990 [JP] Japan ..... 2-288061
Jun. 26, 1991 [JP] Japan ..... 3-181757

[51] Int. Cl.[5] ..... G03G 15/00
[52] U.S. Cl. ..... 346/76 PH; 346/135.1
[58] Field of Search ..... 355/200, 211, 212, 213, 355/279; 346/76 PH, 135.1; 428/331, 421, 480, 500, 523

[56] References Cited

U.S. PATENT DOCUMENTS 2,732,775 1/1956 Young et al. ..... 355/212
3,275,436 9/1966 Mayer ..... 355/267
3,654,461 4/1972 Conix et al. ..... 430/31
3,673,961 7/1972 Jarvis ..... 101/465
3,912,844 10/1975 Endo et al. ..... 430/348
3,955,530 5/1976 Knechtel ..... 355/279 X
4,057,016 11/1977 Endo et al. ..... 355/272 X
4,367,036 1/1983 Sakamaki et al. ..... 355/208
4,463,083 7/1984 Kitajima et al. ..... 346/135.1
4,548,889 10/1985 Nemoto et al. ..... 346/76 PH
4,607,936 8/1986 Miyakawa et al. ..... 355/210
4,654,677 3/1987 Tadauchi et al. ..... 346/76 PH X
4,659,206 4/1987 Kai et al. ..... 355/211
4,785,313 11/1988 Higuma et al. ..... 346/135.1
5,038,166 8/1991 Isaka ..... 346/76 PH
5,107,282 4/1992 Morohoshi et al. ..... 346/76 PH

FOREIGN PATENT DOCUMENTS 0014722 1/1959 Japan .

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

Image forming equipment for applying heat to a charged image carrier to attenuate part of the potential of the image carrier in order to form a latent image on the image carrier. The surface of a dielectric image carrier is charged by a charger and a thermal print head is driven in response to image information in order to form a latent image on the charged surface of the image carrier. A developing roller applies a liquid developer to the latent image and presses it against the portion where the potential has been lowered. The resulting toner image formed on the image carrier is fixed on a paper sheet fed from a paper feeding device or is directly fixed on the image carrier. The image carrier is formed of polyethylene terephthalate or a mixture of polybutylene terephthalate and silicon dioxide.

1 Claim, 29 Drawing Sheets

TEMPERATURE PROGRAM

THERMAL IMAGE FORMING EQUIPMENT FORMS IMAGE DIRECTLY ON IMAGE CARRIER OR PAPER SHEET

BACKGROUND OF THE INVENTION

The present invention relates to a printer, copier, facsimile apparatus or similar image forming equipment which heats a charged image carrier in association with an image to attenuate part of the potential thereof to thereby form a latent image and develops the latent image to produce a visible image.

Image forming equipment extensively used today uses an electrophotographic procedure which charges an image carrier in the form of a photoconductive element, illuminates the charged image carrier by a laser beam representative of document information to electrostatically form a latent image, develop the latent image by a liquid toner or a dry toner to produce a toner image, and transfer the toner image to a paper sheet or similar recording medium. The problem with this type of image forming equipment is that the photoconductive element and an optical unit for exposing it are expensive, increasing the overall cost of the equipment. Another problem is that the optical unit has to be sufficiently screened from external light in order to illuminate only part of the photoconductive element which corresponds to an image. This not only increases the number of parts but also complicates the construction, further increasing the cost of the equipment.

On the other hand, there has been proposed an image forming method which heats a charged image carrier in association with an image to attenuate part of the potential thereof to thereby form a latent image and develops the latent image to produce a visible image, as disclosed in, for example, Japanese Patent Publication Nos. 14722/1960 and 15878/1962. This type of equipment forming a latent image by heat is operable with an image carrier which is far lower in cost than a photoconductive element, and a thermal writing unit which is also far lower in cost than an optical unit. In addition, such equipment does not need a screening implementation. However, this type of equipment has customarily relied only on the drop of electric resistance of the image carrier due to heat. Moreover, such equipment has not given consideration to the stable formation of a latent image or the durability of the image carrier against repetitive use.

SUMMARY OF THE INVENTION

It is, therefore, an object of the present invention to provide image forming equipment which heats a charged image carrier in association with an image to attenuate part of the potential thereof to thereby form a latent image and develops the latent image to produce a visible image, and uses a new image carrier which amplifies potential attenuation ascribable to heat.

It is another object of the present invention to provide image forming equipment which heats a charged image carrier in association with an image to attenuate part of the potential thereof to thereby form a latent image and develops the latent image to produce a visible image, and insures stable formation of a latent image and the durability of the image carrier against repetitive use.

In accordance with the present invention, in image forming equipment for applying heat to a charged image carrier in association with an image to attenuate part of the potential of the image carrier to thereby form a latent image matching the image on the image carrier and then developing the latent image to produce a visible image, the image carrier comprises a dielectric body which makes, when charged and then heated, the motion in molecules thereof active to allow electrons to move easily, thereby undergoing potential attenuation.

Also, in accordance with the present invention, in the above-described type of image forming equipment, the image carrier comprises a dielectric body which releases, when heated, trapped charges to thereby undergo potential attenuation.

Further, in accordance with the present invention, in the above-described type of image forming equipment, the image carrier comprises a dielectric body which forms, when heated, mobile ions to thereby cause a charge leak, thereby undergoing potential attenuation.

Further, in accordance with the present invention, in the above-described type of image forming equipment, the image carrier comprises a dielectric body constituted by a substance having a potential attenuation start temperature higher than an ambient temperature at which the image carrier is used.

Further, in accordance with the present invention, in the above-described type of image forming equipment, the image carrier comprises a dielectric body constituted by a polar crystallized high molecular substance having a glass transition temperature higher than an ambient temperature at which the image carrier is used.

Further, in accordance with the present invention, the above-described type of image forming equipment comprises a thermal writing section for applying heat to the image carrier in association with an image, and a drive section for driving the thermal writing section such that the highest temperature on the surface of the image carrier contacting the thermal writing section lies in a range higher than a temperature which causes the potential attenuation of the image carrier to begin and lower than the thermal deformation temperature of the image carrier.

Moreover, in accordance with the present invention, the above-described type of image forming equipment comprises a fixing device for fixing the visible image on the image carrier, and a discharging section for discharging the image carrier to the outside of the equipment.

In addition, in accordance with the present invention, the above-described type of image forming equipment comprises a fixing device for fixing the visible image on a support body, a transfer medium feeding device for feeding a transfer medium to the surface of the image carrier carrying the visible image thereon while the image carrier is transported, and a transporting device for driving, when a transfer medium is not fed from the transfer medium feeding device, the image carrier carrying the visible image to the outside of the equipment via the fixing device or driving, when a transfer medium is fed from the transfer medium feeding section, the transfer medium to the outside of the equipment together with the image carrier via the fixing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

An image forming process particular to the image forming equipment of the present invention will be described first.

Figure 1:
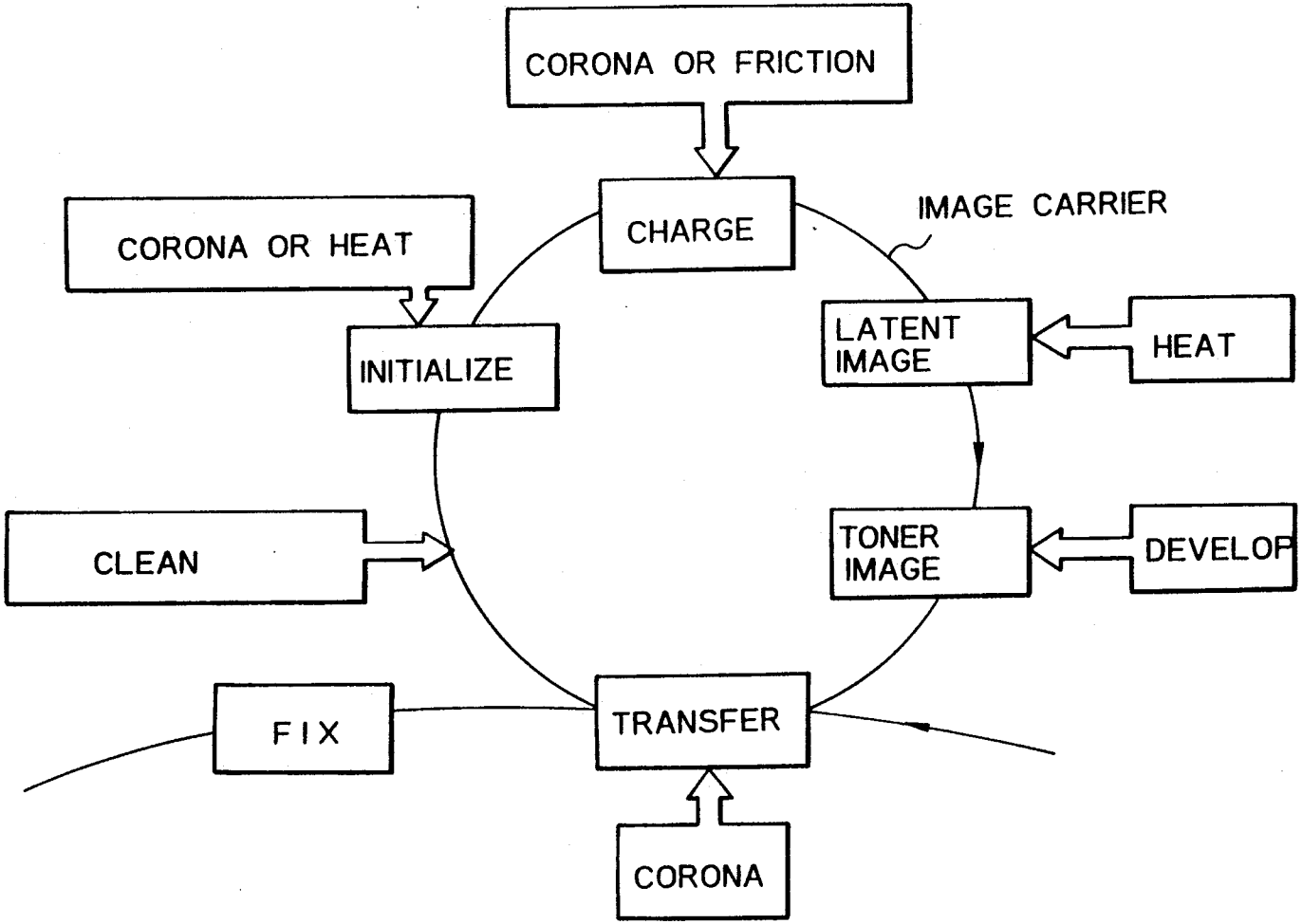
FIG. 1 is a block diagram schematically showing an image forming process which uses an image carrier repetitively in forming images.

Referring to FIG. 1, an image forming process which uses an image carrier repetitively is outlined. The process shown in FIG. 1, like an electrophotographic process, charges an image carrier, forms a latent image thereon, develops the latent image, transfers the developed image to a recording medium, cleans the image carrier after image transfer, and then initializes the image carrier. The difference is that the process of FIG. 1 replaces light for forming a latent image with heat, replaces corona discharge or similar implementation for initialization with heat, and practically uses friction charging for a charging purpose. The cleaning step mentioned above is omissible if the developed image on the image carrier can be substantially fully transferred to a recording medium. The prerequisite with such an image carrier to be repetitively used is that it be free from deformation due to heat, not to speak of the attenuation characteristic of charge potential due to heat.

Figure 2:
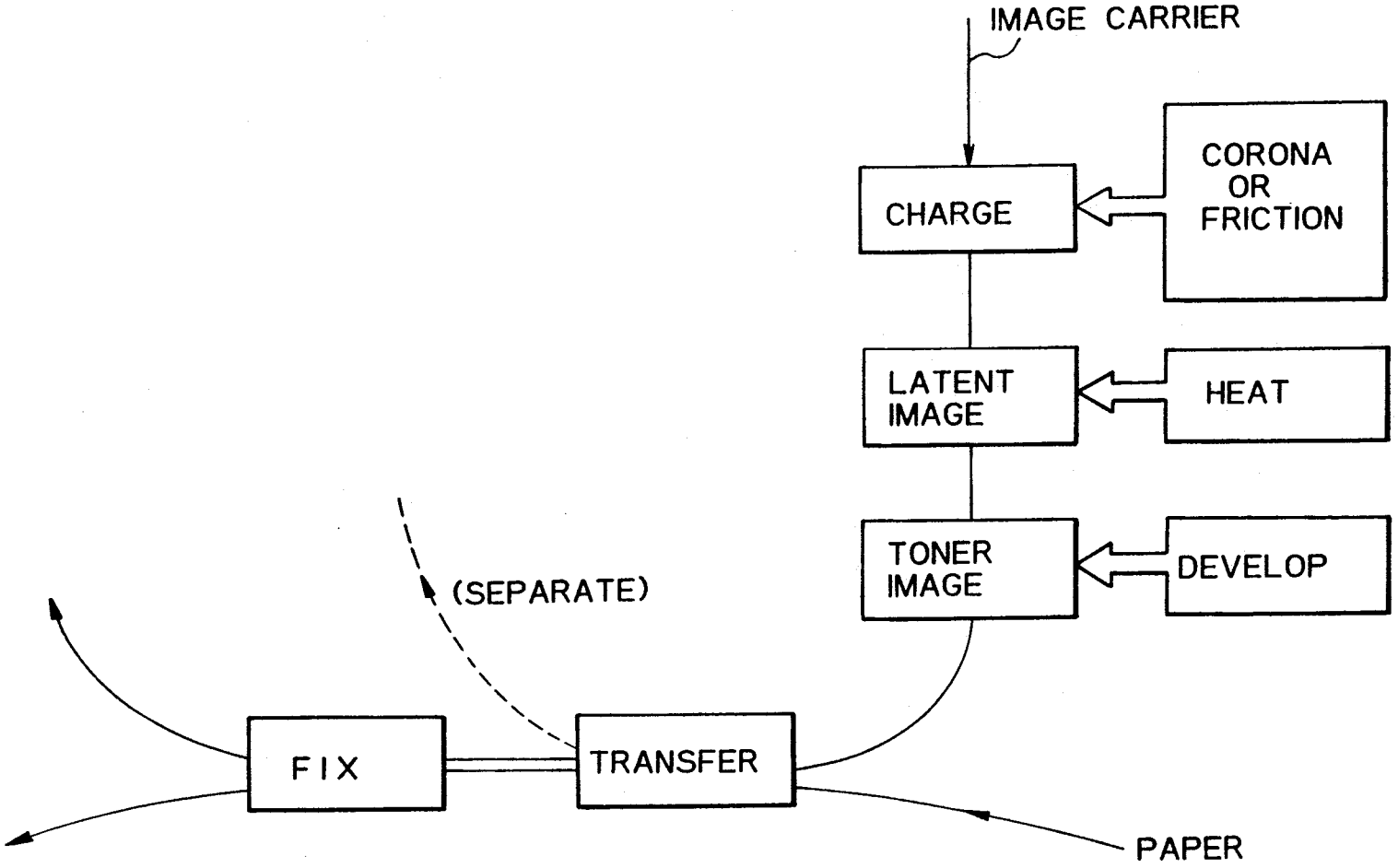
FIG. 2 is a block diagram schematically showing an image forming process which uses an image carrier only once in forming images.

FIG. 2 outlines an image forming process which uses an image carrier only once for image formation. This kind of process is practicable without resorting to the cleaning step and initializing step stated above. In this case, the condition that the image carrier is free from deformation due to heat is not necessary, although the attenuation characteristic due to heat is necessary. After image transfer, the image carrier may be transported through a fixing device together with a paper sheet and then separated from the latter, as indicated by a solid line in FIG. 2. Alternatively, the image carrier having undergone image transfer may be separated from the paper sheet before fixation. Furthermore, the image carrier itself may be used as the final image supporting body, in which case the image transfer is omitted also. The image carrier, like a thermal transfer sheet, may be held in the equipment in the form of a roll, paid out to extend through a transfer region, and taken up at the end thereof. Alternatively, cut lengths of sheets of size A4 or A5, for example, may be transported through a charging station, latent image forming station, etc.

Figure 3:
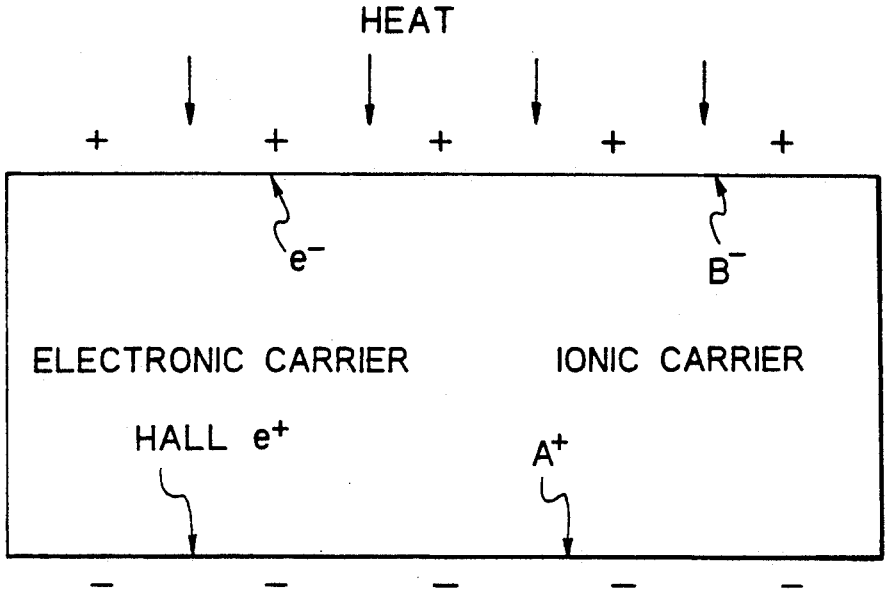
FIG. 3 shows the electronic conduction and ionic conduction of a dielectric body.
Figure 4:
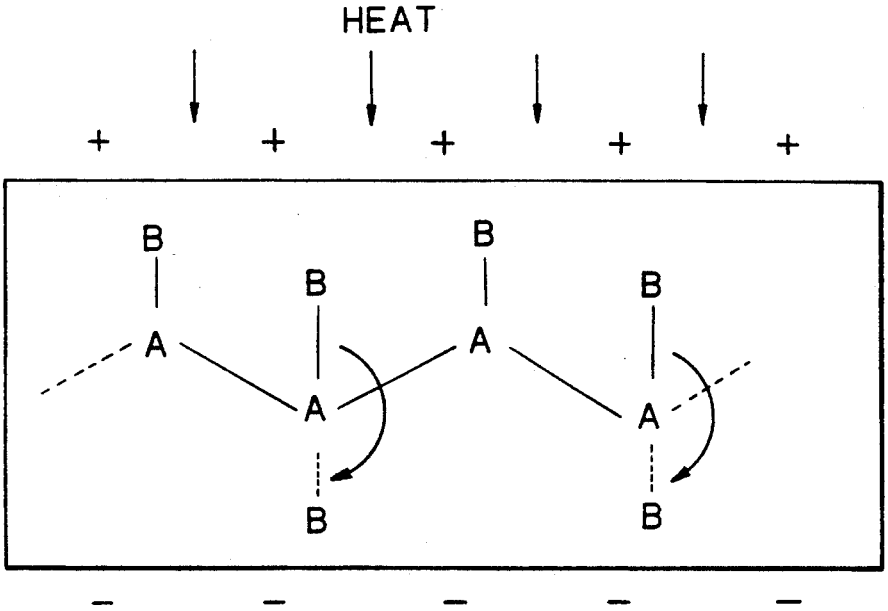
FIG. 4 shows the depolarization of a dielectric body.

An image carrier applicable to the equipment of the present invention will be described. The image carrier, whether it be used repetitively or only once, has to have an attenuation characteristic of charge potential due to heat. The attenuation of charge potential, or simply potential, depends on the kind of a dielectric substance constituting the image carrier. Generally, a dielectric body is charged by either of trapped electrons ascribable to charge injection and polarization (electron polarization, ion polarization or orientation polarization). The potential attenuation in the former case occurs because the electrons leak due to a carrier while the potential attenuation in the latter case is ascribable to the neutralization of the polarized state. More specifically, when use is made of a dielectric body which has trapped electrons due to forced charge injection, there occurs either electronic conduction wherein electrons are excited by heat to generate an electronic (positive hole) carrier to thereby cause the migration of charge or ionic conduction wherein an ionic carrier generated by heat causes the migration of charge (see FIG. 3). When a dielectric body forcibly polarized from the outside is heated, dipoles in the molecules become free to rotate to neutralize the dipole moment with the result that depolarization and, therefore, potential attenuation occurs (see FIG. 4). The potential attenuation characteristic of a dielectric body which has the electrical characteristic thereof is determined by the mixture of an electronic carrier, ionic carrier (movable ions) and dipoles existing in the dielectric body.

Figure 5:
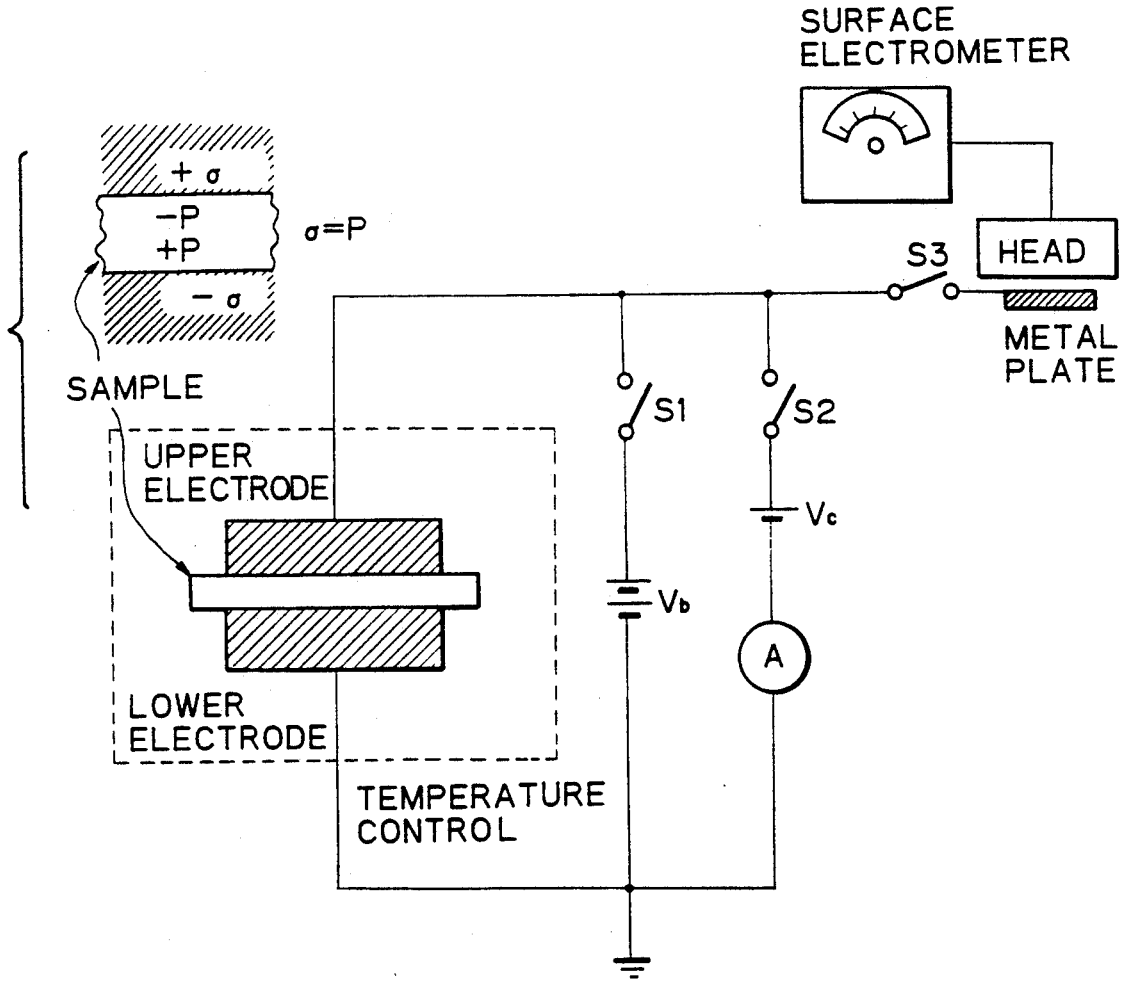
FIG. 5 is a circuit diagram showing a specific device for measuring a thermally stimulated current (TSC) flowing through a dielectric body.
Figure 6:
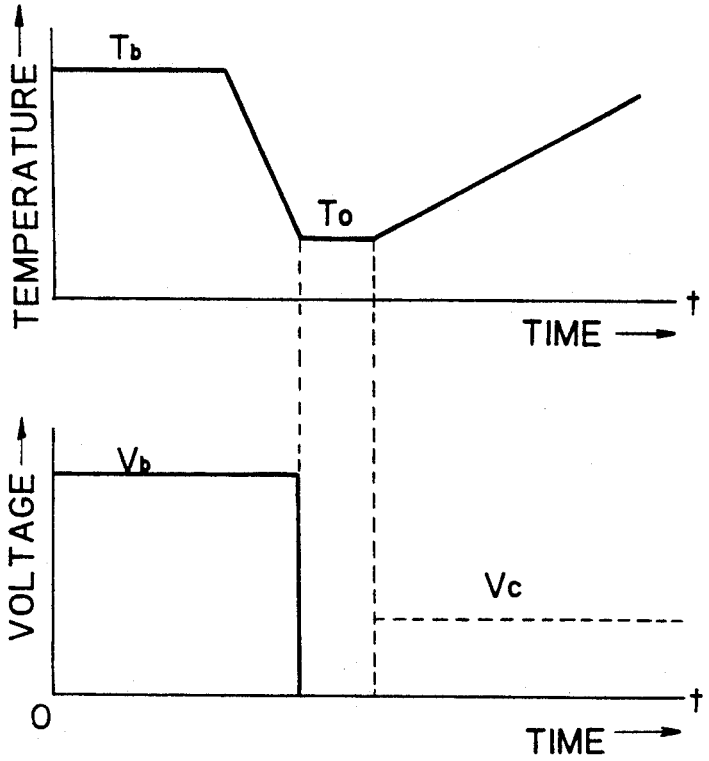
FIG. 6 is a graph showing a relation between the temperature of a sample shown in FIG. 5 and a voltage applied thereto.

Which of the above-mentioned factors has the major influence on the potential attenuation can be determined if the thermally stimulated current (TSC) of the dielectric body is measured. FIG. 5 shows a specific circuit arrangement for measuring TSC. In FIG. 5, a voltage Vb is applied to a sample at a certain high temperature Tb to cause charge injection, charge trapping, polarization and spatial charge to occur. Then, the sample is cooled to a relatively low temperature to freeze the polarization and injected trapped charge. Subsequently, the sample is heated at a predetermined rate while measuring TSC. At this instant, the temperature of the sample and the voltage change with respect to time, as shown in FIG. 6. To measure TSC, switches S and S3 shown in FIG. 5 are opened while a switch S2 is closed. In this condition, the current flowing to the external circuit due to the depolarization and detrapping of the sample is measured by an ammeter A. This current is TSC. Further, when the switches S1 and S2 are opened and the switch S3 is closed, the potential of a metallic plate is measured by a surface electrometer and determined to be the surface potential of the sample, i.e., TSSP. In addition, in the event that the sample is heated, thermoluminescence from the sample is measured to recognize the existence of an electronic trapped charge.

Figure 7:
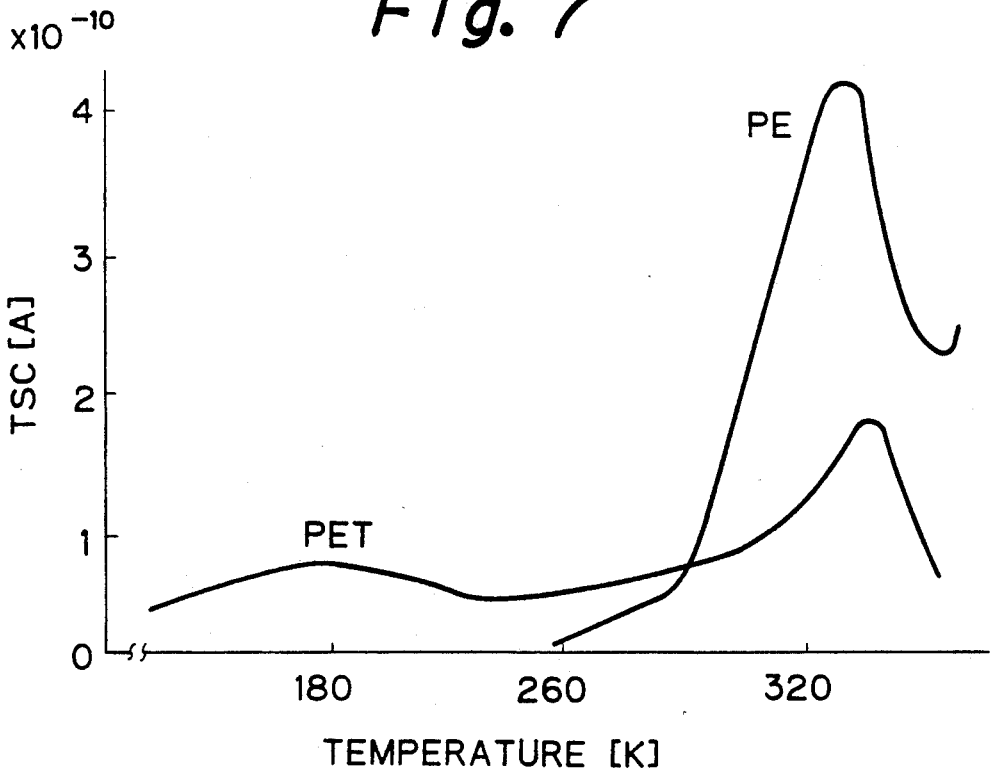
FIG. 7 is a graph showing a relation between the TSC and the temperature actually measured with polyethylene (PE) and polyethylene terephthalate (PET)
Figure 8:
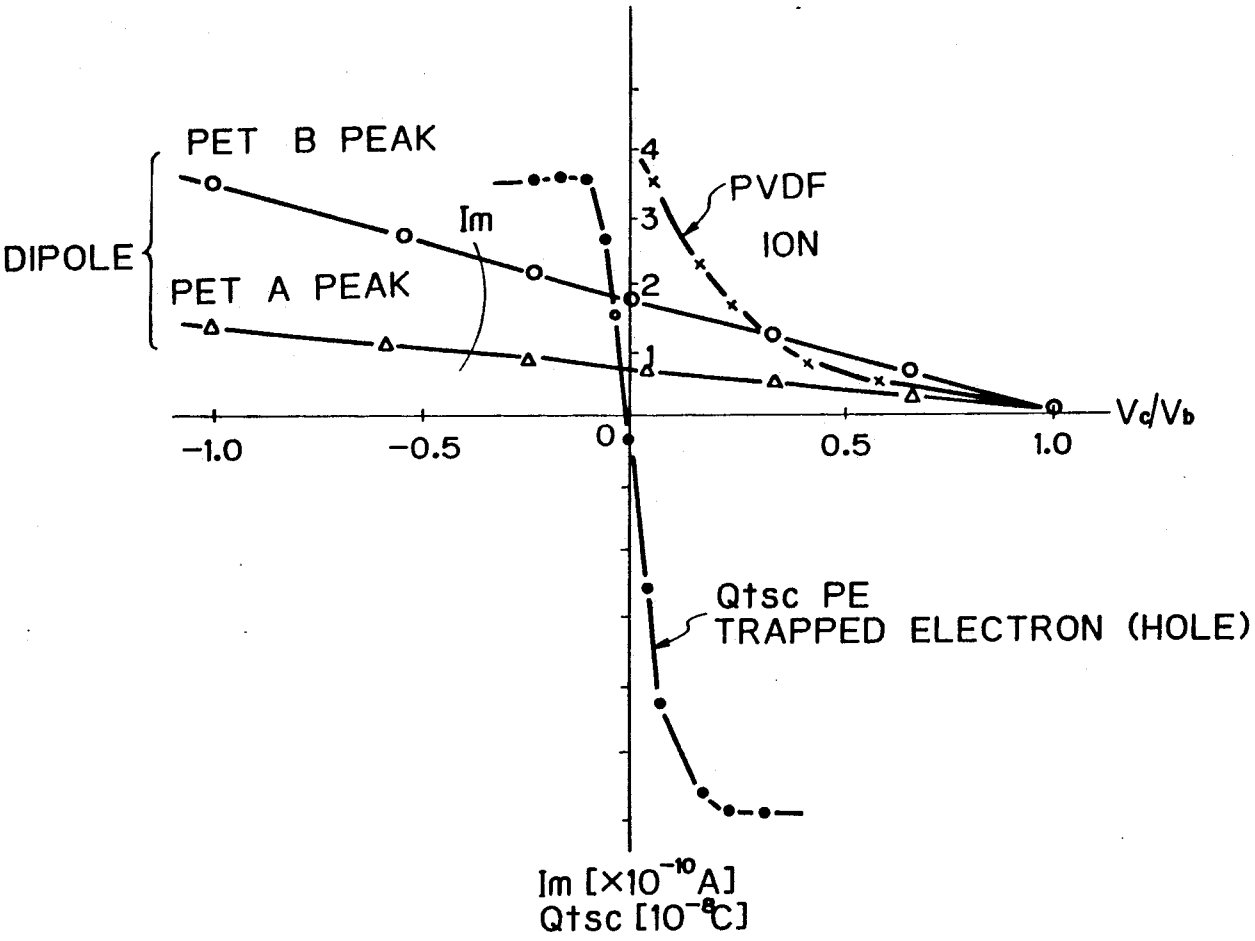
FIG. 8 shows a relation between the TSC charge Qtsc and Vc/Vb with respect to PET, PE, and polyvinylidene fluoride (PVD)

FIG. 7 shows temperatures and TSCs actually measured with polyethylene (PE) and polyethylene terephthalate (PET). FIG. 8 shows a relation between the TSC charge Qtst and Vc/Vb derived from TSCs which were measured with PET, polyvinylidene fluoride (PVDF), and PE. As FIG. 8 indicates, the TSCs of trapped electrons (positive holes), mobile ions and polarization (dipole) each has a unique feature and is useful in determining the mechanism of electric conduction in a dielectric material.

For example, PET has the following structure:

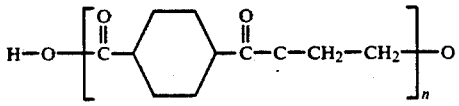

Presumably, the A peak of TSCs shown in FIG. 8 is the polarization ascribable to the rotation of the dipoles in the end group O—H, while the B peak is ascribable to the dipoles of C=O which rotate and polarize when the straight-chain molecules shown above perform the micro-Brownian motion.

PE has the following structure:

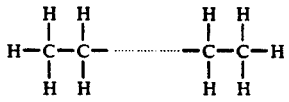

As shown, PE is non-polar, i.e., the molecules are not biased. The TSCs shown in FIG. 8 are presumably ascribable to the injected trapped electrons (or holes).

The above description applies to relatively pure materials.

The image carrier of the present invention should be implemented with a dielectric body whose potential attenuates by heat after charging, as stated above. Such a characteristic will be described specifically hereinafter.

Figure 9:
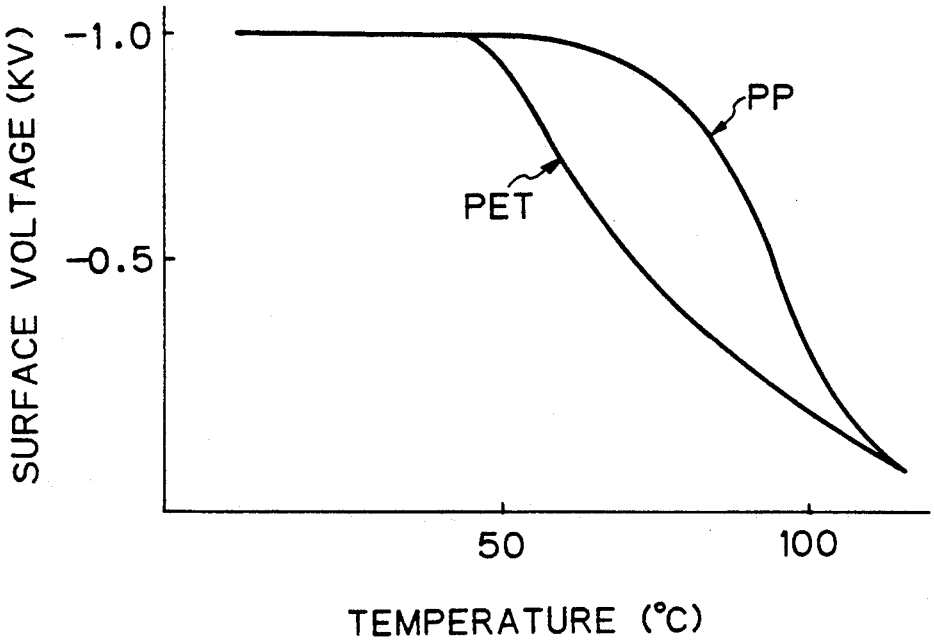
FIG. 9 shows the attenuation of a potential occurring when a dielectric body is charged to −100 volts.
Figure 10:
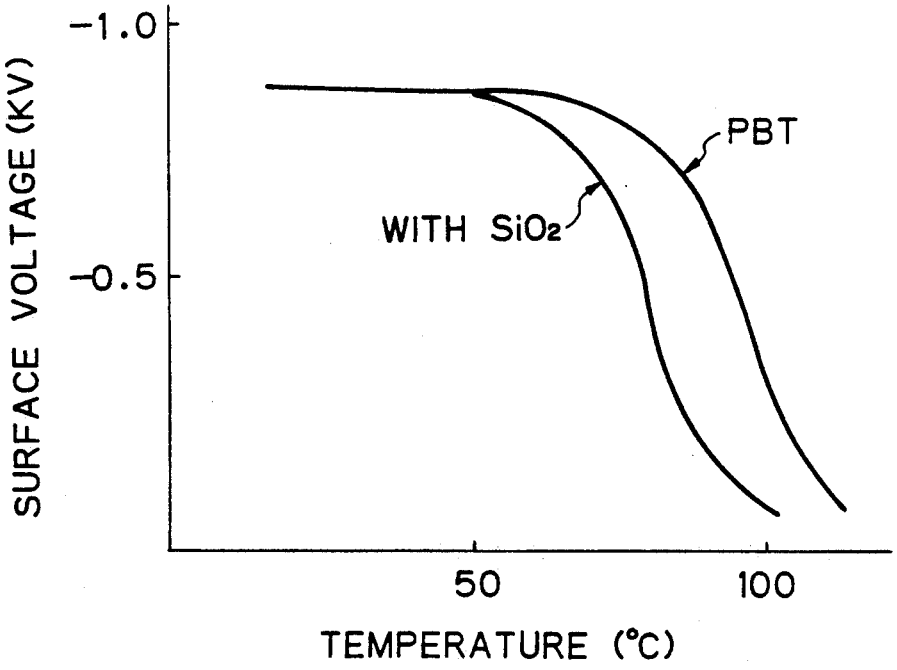
FIG. 10 shows potentials of a dielectric body determined by measurement.

FIG. 9 shows a specific case wherein an image carrier is heated at a constant elevation rate with the result that a charge of −1000 volts is attenuated. As shown, a difference in potential attenuation ascribable to a difference in material appears as in the case of TSC and corresponds to TSC of FIG. 7. FIG. 10 shows surface potentials measured with a sheet produced by molding polybutylene terephthalate (PBT), a main resin, to which several weight percent of fine particles of $SiO_2$ is added. As FIG. 10 indicates, the additive shifts the potential attenuation to the lower temperature side. Such a change in characteristic is dependent on the molding method also. Introducing such an additive which promotes the potential attenuation mechanism in the dielectric body, or image carrier, or setting up such an internal state is effective when desired potential attenuation is to be selected, allowing potential attenuation to be designed in any desired manner. For example, there may be added a low molecular substance (e.g. carbon black) which is easy to generate an ionic carrier for releasing trapped electrons, or a substance enhancing the heat accumulation effect and, therefore, the heat transfer efficiency (e.g. metal powder). Further, inorganic particles may be added to improve the durability of the image carrier and to eliminate thermal deformation. Some inorganic particles are capable of changing the above-stated potential attenuation characteristic.

As the temperature at which the attenuation begins, i.e., potential attenuation start temperature Ts decreases, the writing temperature for forming a latent image can be lowered. However, if the temperature Ts is lower than room temperature or ambient temperature at the time of use (inside the equipment), it is likely that the potential attenuation will begin at such a temperature or begin uniformly immediately after charging to prevent a charge potential from being stably developed, obstructing the stable formation of a latent image. The prerequisite is, therefore, that the potential attenuation start temperature Ts be higher than room temperature or ambient temperature at the time of use.

The potential attenuation start temperature Ts depends on the molding method and the additive also, as stated above. For example, a dielectric body constituted by polyethylene terephthalate, polybutylene terephthalate, polysulphone, acid anhydride hardening epoxy resin, polymethyl methacrylate, unsaturated polyester, polystyrene, polyvinyl chloride, polyvinyl acetate or similar polar crystalline high molecular substance having a potential attenuation start temperature Ts which is substantially the same as the glass transition temperature thereof (this also depends on the molding method and additive). Presumably, this is because the molecules constituting the substance become active at the glass transition start temperature and structurally assume an amorphous state, thereby releasing trapped electrons or promoting the rotation of dipoles formed in one direction. The rotation of dipoles results in depolarization. To measure the potential attenuation start temperature, use may be made of the conventional system shown in FIG. 5 arranged to measure TSC or TSSP.

Figure 11:
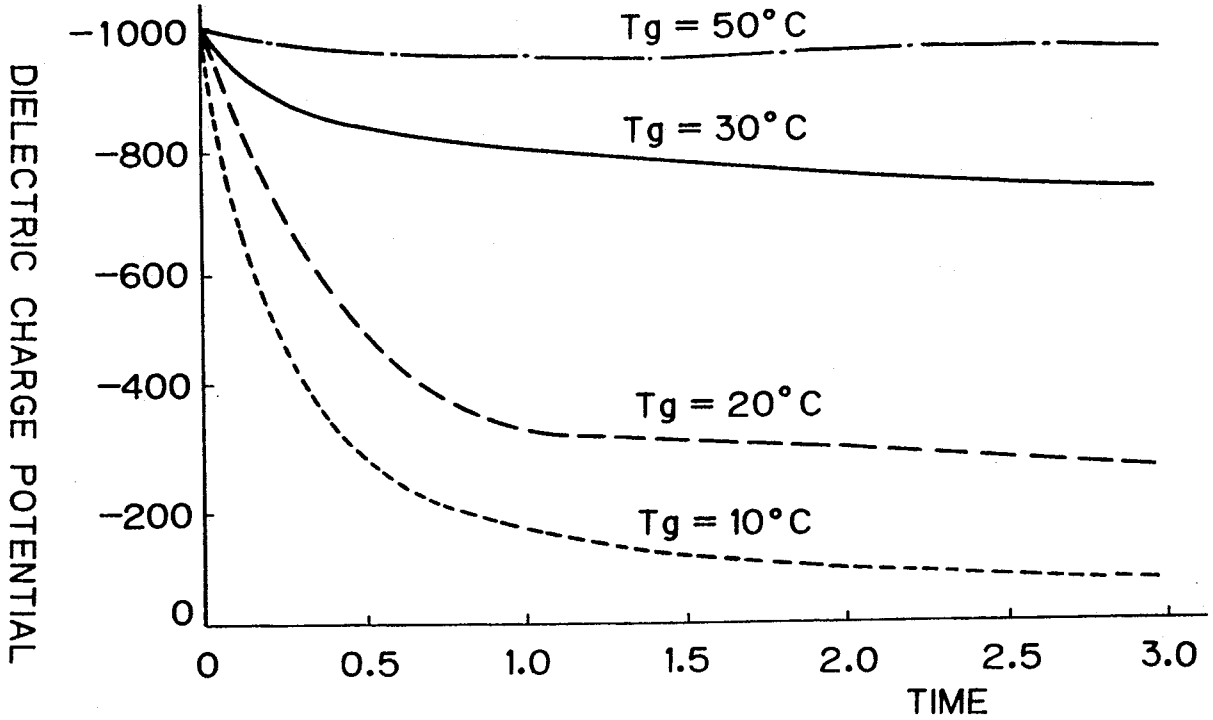
FIG. 11 shows a variation of charge potential due to aging with respect to dielectric bodies each having a particular glass transition temperature.

FIG. 11 shows potential attenuation measured with each of dielectric bodies formed of substances each having a different potential attenuation start temperature Ts and by charging them to −1000 volts and then leaving them at room temperature (27 degrees). As shown, the dielectric whose potential attenuation start temperature is 50 degrees does not attenuate the potential even on the lapse of 3 minutes and maintains a stable charge potential. The dielectric body having a potential attenuation start temperature of 30 degrees causes the potential to attenuate slightly and slowly, but it still holds a potential of about 800 volts even after 3 minutes and is capable of forming a latent image sufficiently. However, the dielectric body whose potential attenuation start temperature is 20 degrees or 10 degrees lower than room temperature causes the potential thereof to sharply attenuate, failing to form an image satisfactorily. Preferably, therefore, use is made of a dielectric body whose potential attenuation start temperature is higher than room temperature, desirably 10 degrees to 15 degrees higher than the ambient temperature. The writing temperature in the latent image forming section has to be higher than the potential attenuation start temperature. However if the writing temperature is higher than the thermal deformation temperature of the dielectric body, the dielectric body is apt to deteriorate or suffer from thermal deformation. Then, while the dielectric body is repetitively used, the image will be locally disturbed; as the dielectric body is used a great number of times, an image will not be formed at all. To eliminate such an occurrence, a dielectric body whose potential attenuation start temperature is lower than the thermal deformation temperature is used. Further, if the potential attenuation start temperature and the thermal deformation temperature are relatively close to each other, the deterioration of the dielectric body will be accelerated to reduce the service life of the dielectric body. In light of this, the thermal writing temperature should preferably range from 10 degrees to 20 degrees. While a method of measuring thermal deformation temperature is prescribed in any of JIS K7206 and K7207, ISO 75, 306 and 2799, and ASTM D648, D1043 and D1525, a method which will be described hereinafter is used in matching relation to the internal conditions of equipment under which the dielectric body is used.

Figure 12:
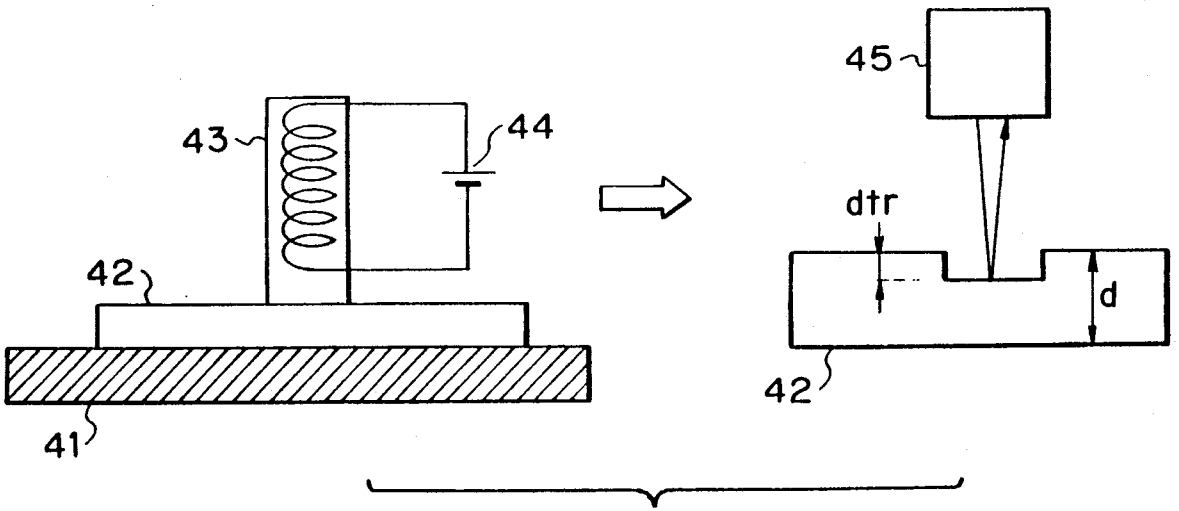
FIG. 12 shows a specific method of measuring the thermal deformation temperature of a dielectric body.

FIG. 12 outlines the measuring system. As shown, a sample in the form of a sheet 42 is affixed to an elastic body 41 whose hardness is 55 degrees. A heater 44 heats the bottom of a cylinder 43 having a diameter of 1 centimeter to a desired temperature. After the cylinder 43 has been pressed against the sample 42 for about 5 seconds by a load of 4 grams per square millimeter, the deformation is measured by non-contact type laser displacement gauge 45. Thereupon a deformation ratio is produced by:

$$\text{deformation ratio } (\%) = (d - dtr)/d \times 100$$

where d and dtr are respectively the thickness of the sample 42 before deformation and the deformation of the sample 42. Regarding the hardness and load, an elastic body 41 closest to the actual conditions in the equipment is used. Some deformation is allowable if the deformation ratio is adaptive to repetitive use.

Figure 13:
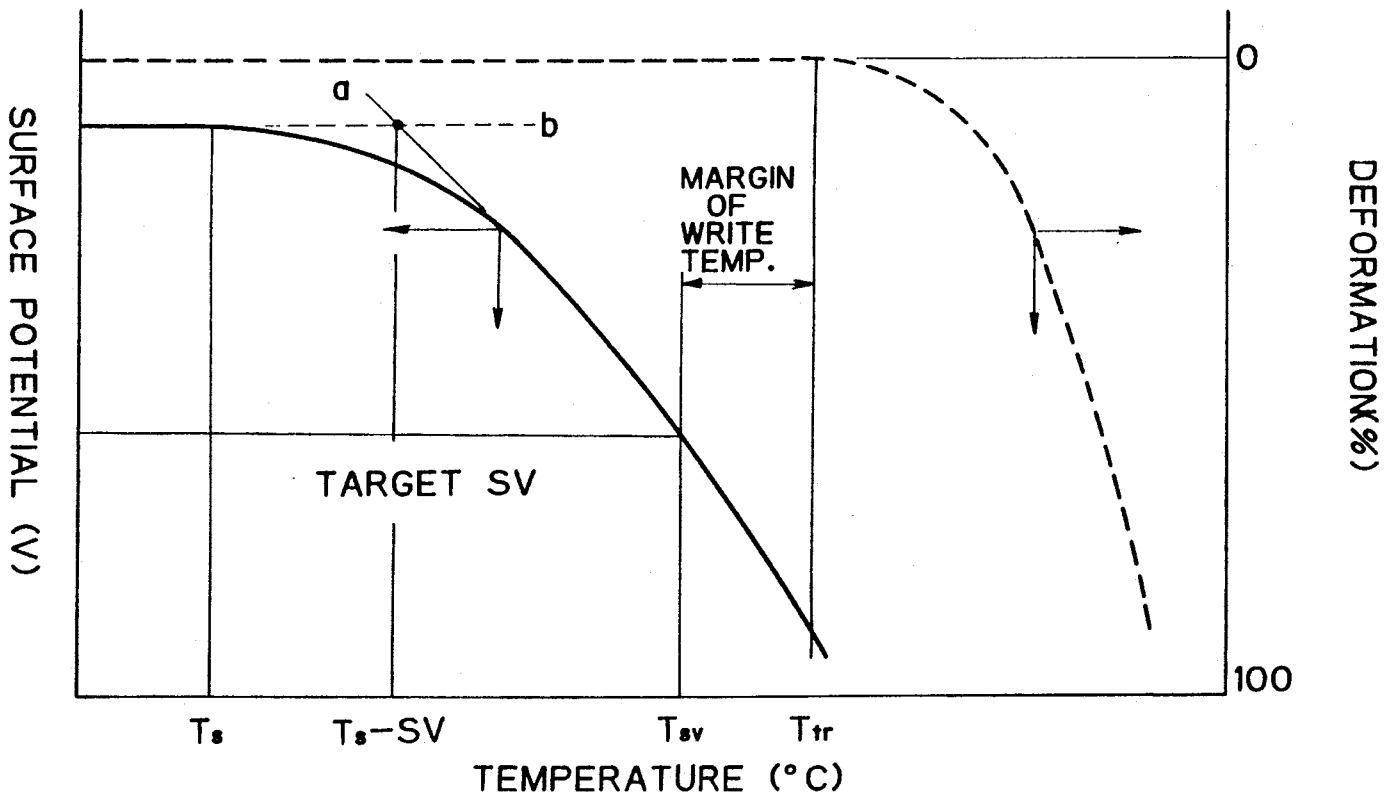
FIG. 13 shows an ideal relation between the attenuation of surface potential of a dielectric body due to heat and the deformation rate.

FIG. 13 shows an ideal relation between the attenuation of surface potential due to heat and the deformation ratio of a material. Assume that equipment forms a latent image by lowering the potential (absolute value) of an image portion (where a toner should be deposited) than in a non-image portion (where a toner should not be deposited), that the potential attenuation start potential is Tg, that the target potential SV of an image portion is reached at a temperature Tsv, and that the thermal deformation temperature of a dielectric is Ttr. Then, a relation $Ts < Tsv < Ttr$ should preferably hold, as shown in FIG. 13. As the difference between Tsv and Ttr increases, the load acting on the dielectric body decreases, promoting stability against aging and increasing the service life.

Figure 14:
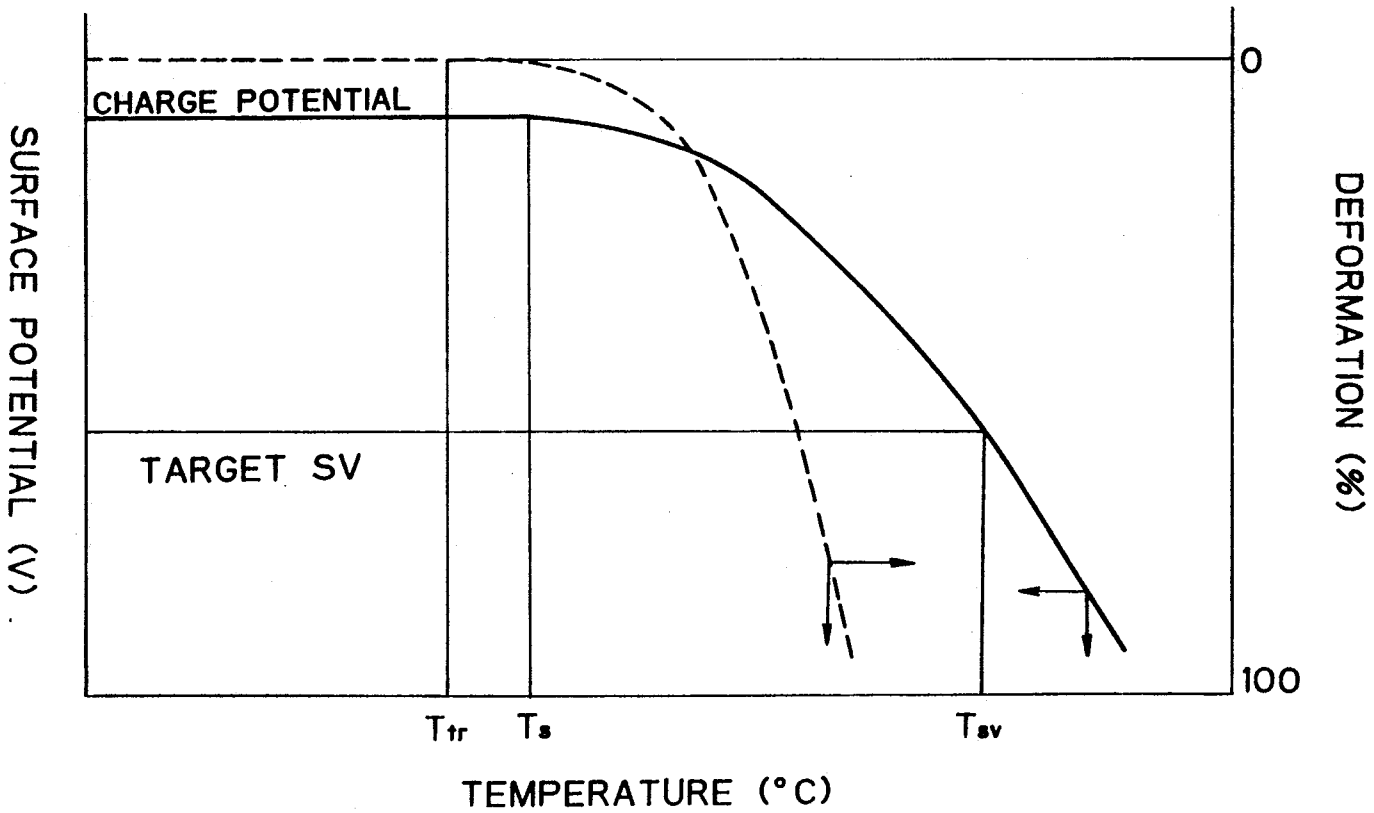
FIG. 14 is a graph similar to FIG. 13, showing an undesirable relation between the same.

FIG. 14 shows a specific undesirable relation between the attenuation of surface potential and the deformation ratio of a material. As shown, the dielectric body starts deforming before potential attenuation begins and, therefore, has to be discarded when used once.

Dielectric bodies satisfying all the above conditions are, for example, polypropylene (P.P), polyethylene terephthalate (PET), and polybutylene terephthalate (PBT). Such substances were cut into sheets and measured to have potential attenuation start temperatures and thermal deformation temperatures by the previously stated measuring method, as shown in Table 1 below:

TABLE 1

| | POTENTIAL ATTEN START TEMP (°C.) | THERMAL DEFORM TEMP (°C.) | EVALUATION |
|---|---|---|---|
| P.P | 94 | 110 | GOOD |
| PET | 75 | 130 | GOOD |
| PBT | 37 | 130 | GOOD |
| PI | 300 | 180 | NO GOOD |
| PS | 200 | 140 | NO GOOD |

Among P.P, PET and PBT, PET has a relatively great difference between the potential attenuation start temperature and the thermal deformation temperature and has a relatively low potential attenuation start temperature and can write image data when the drive power is relatively low. Nevertheless, an optimal dielectric body should preferably be selected on the basis of the correlation of the potential attenuation start temperature, the heat deformation temperature, and the ability of the writing means when it comes to an image carrier. It is to be noted that polyimide (PI) and polysulfone (PS) listed for comparison in Table 1 cannot implement a repetitively usable dielectric body because their potential attenuation start temperatures are higher than thermal deformation temperatures.

Figure 15:
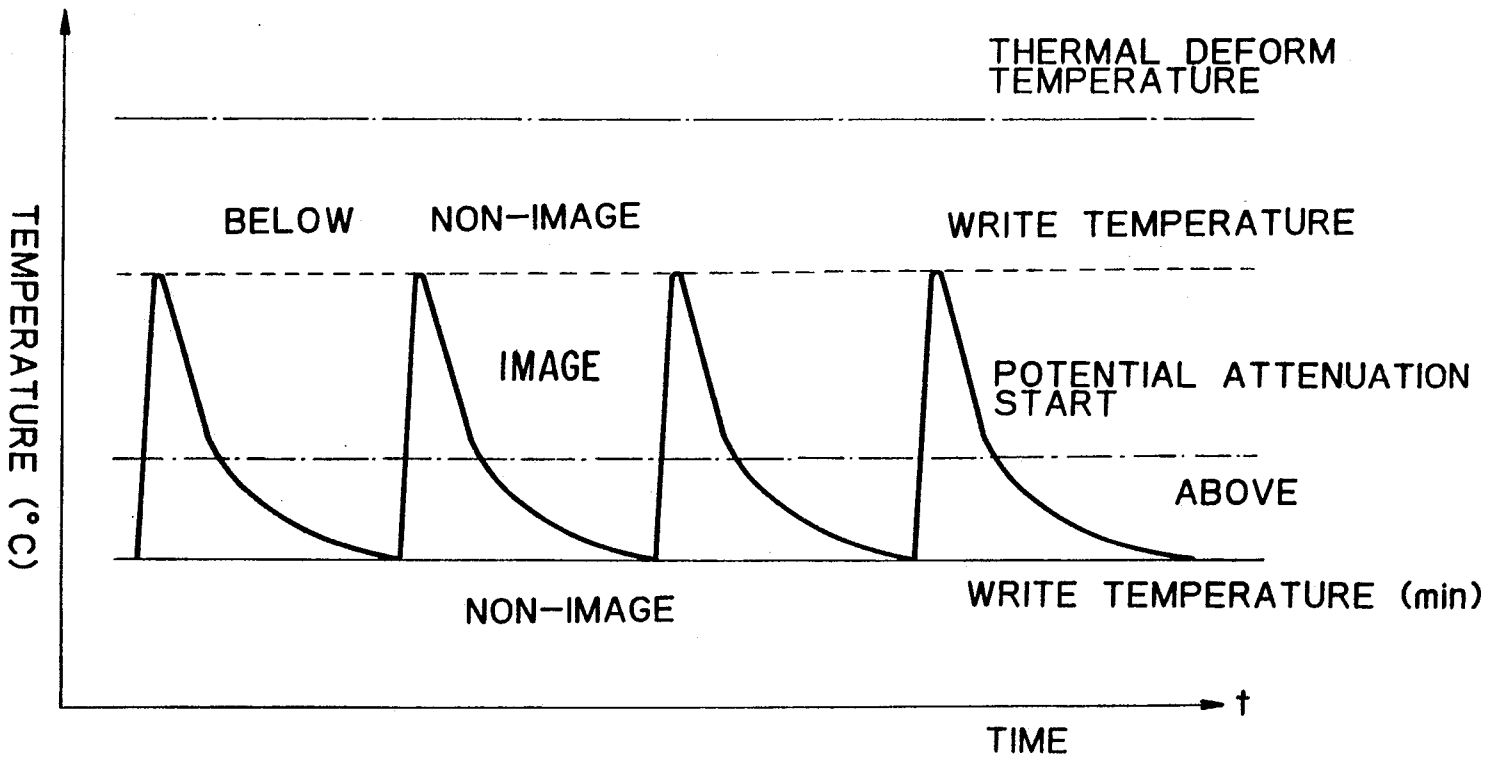
FIG. 15 shows an ideal relation between the write temperature of a thermal print head and the glass transition temperature and thermal deformation temperature.
Figure 16:
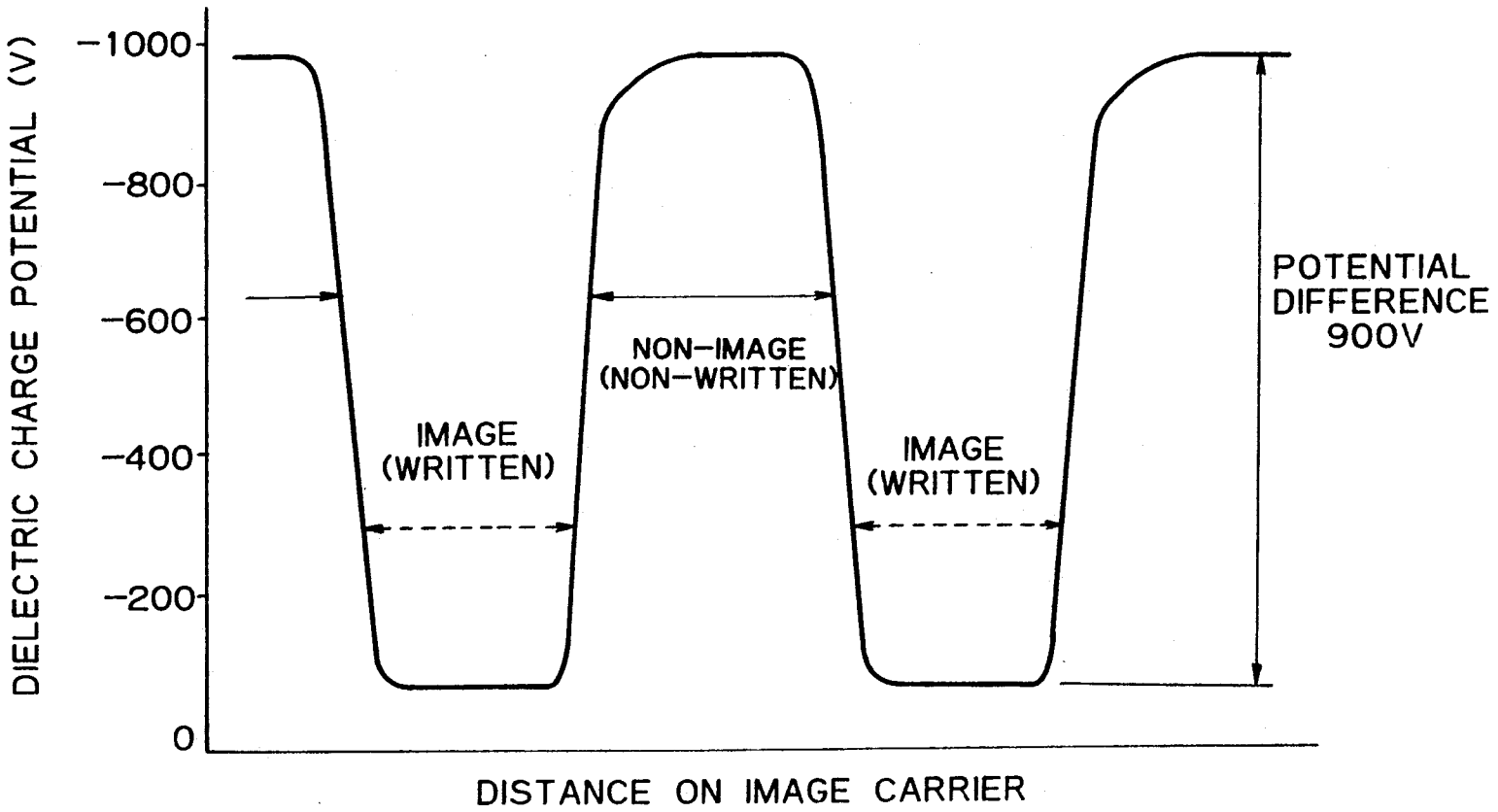
FIG. 16 shows the potentials of a latent image produced by using a dielectric belt implemented by PBT and uniformly charging it to −1000 volts.

FIG. 15 shows an ideal relation between the writing temperature of a thermal print head or similar thermal writing means and the potential attenuation start temperature and thermal deformation temperature applicable to negative-to-positive development. As shown, among the three temperatures, the thermal deformation temperature is highest. The higher the thermal deformation temperature, the higher the writing temperature can be set. Further, as the writing temperature rises due to the ability of the writing means, writing is achievable even if the potential attenuation start temperature is high. FIG. 16 shows latent image potentials measured with the PBT dielectric belt and a voltage of −1000 volts for uniform charge. While the amount of heat to be applied to the writing means changes with the heat capacity which is determined by the thickness of the belt, the linear velocity and thickness of the belt 1 are adjusted such that about 100 degrees is applied to the surface of the belt 1 that contacts the writing section. As FIG. 16 indicates, the potential in the image portion is attenuated to about −100 volts in the case of negative-to-positive development. The difference in potential between the image portion and the non-image portion is as great as more than 900 volts which is sufficient for development. This proves that the dielectric body is comparable with the photoconductive element of the conventional electrophotographic system as to ability.

A specific construction of the image forming equipment using an image carrier made of a dielectric material will be described.

Figure 17:
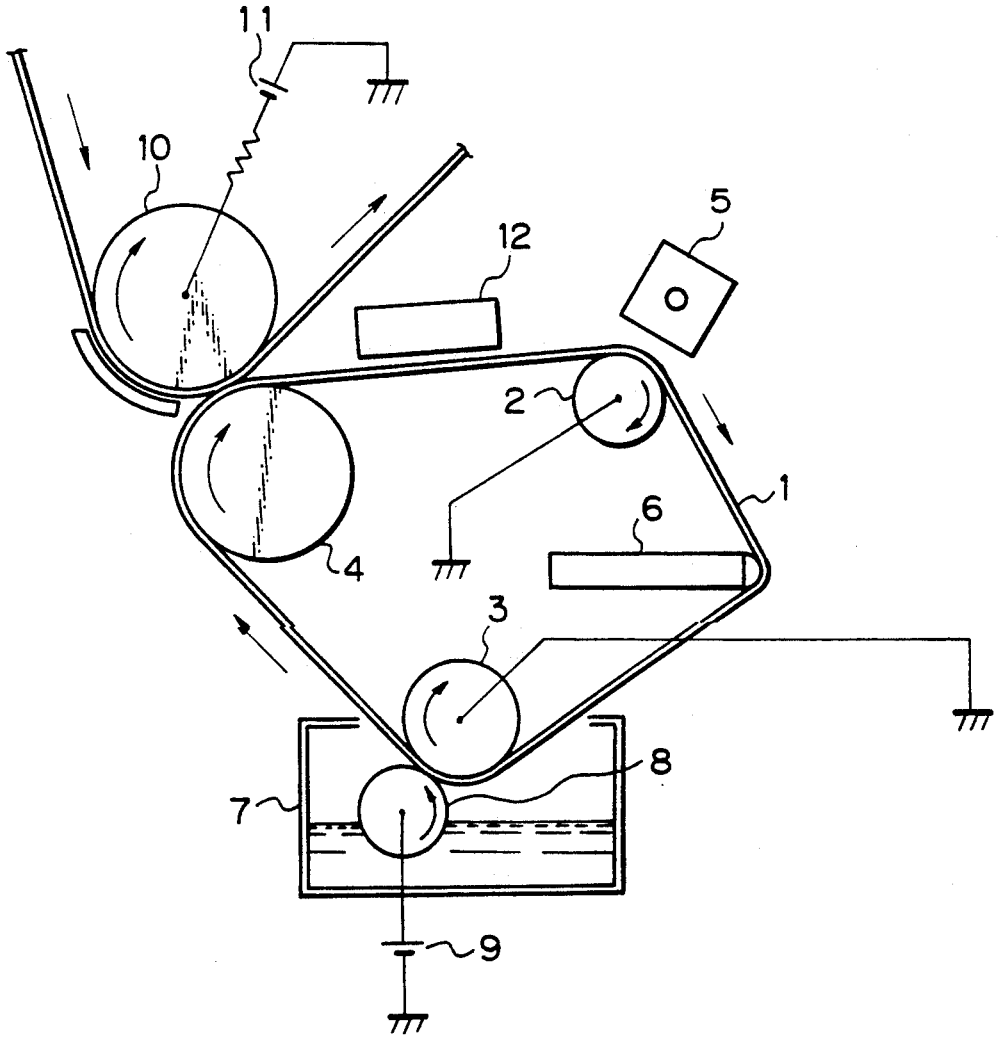
FIGS. 17–20 are front views showing alternative embodiments of the present invention.

FIG. 17 shows image forming equipment of the type using a dielectric image carrier repetitively for image formation, i.e., the process shown in FIG. 1. As shown, a dielectric image carrier in the form of a belt 1 is passed over a charging electrode roller 2, a developing electrode roller 3, and a transferring electrode roller 4. Any one of these rollers 2–4 is implemented as a drive roller. A charger 5 is located to face the surface of the belt 1, constituting a charging section. A line type thermal print head 6 serves as writing means and is held in contact with the rear of the belt 1 between the electrode rollers 2 and 3. A developing roller 8 contacts a portion of the belt 1 which wraps around the roller 3. The developing roller 8 has a lower portion thereof immersed in a liquid developer stored in a developing tank 7 and constitutes a developing section. A bias power source 9 for reversal development is connected to the developing roller 8. A transferring and fixing roller 10 contacts a portion of the belt 1 which wraps around the electrode roller 4, forming a transferring and fixing section. A heating lamp, not shown, is accommodated in the transferring and fixing roller 10 and receives power from source 11. A cleaning device, or cleaning section, is positioned at the front of the belt 1 between the electrode rollers 4 and 2. A paper feeding device and a paper discharging device, not shown, are also included in the equipment.

In operation, in response to a record start command, the charger 5 located in the charging section uniformly charges the surface of the belt 1 being rotated by corona discharge. As the charged surface of the belt 1 reaches the latent image forming section, the print head 6 generates heat in response to image data to thereby form a latent image on the belt 1. The developing roller 8 applies the liquid developer to the latent image as the belt 1 arrives at the developing section. Consequently, a charged toner contained in the liquid developer is pressed against the area of the belt 1 where the potential has been lowered by the heat of the print head 6, thereby effecting reversal development. On reaching the transferring and fixing section, the developed image or toner image is transferred from the belt 1 to an image support in the form of a paper sheet which is fed from the paper feeding device, while being fixed on the paper sheet. At the same time, the charge on the belt 1 is uniformly attenuated by the transferring and fixing roller 10 and thereby initialized. Subsequently, the surface of the belt 1 is cleaned by the cleaning device 12 to prepare for the next uniform charging step. The paper sheet carying the toner image thereon is driven out of the equipment by the discharging device.

Because the embodiment described above effects image transfer and fixation at the same time, it is not necessary for the transferring and fixing roller 10 to be provided with an anti-offset layer which is indispensable with the conventional fixing roller contacting a toner image, cutting down the cost of the fixing roller. The dielectric belt 1 differs from a conventional organic photoconductive belt in that the characteristic thereof is not susceptible to the liquid developer. Therefore, the image carrier itself is inexpensive and operable with a liquid developer type developing system which insures high image quality (a photoconductive element using selenium and used with the conventional liquid type development is even more expensive than an organic photoconductive element).

Figure 18:
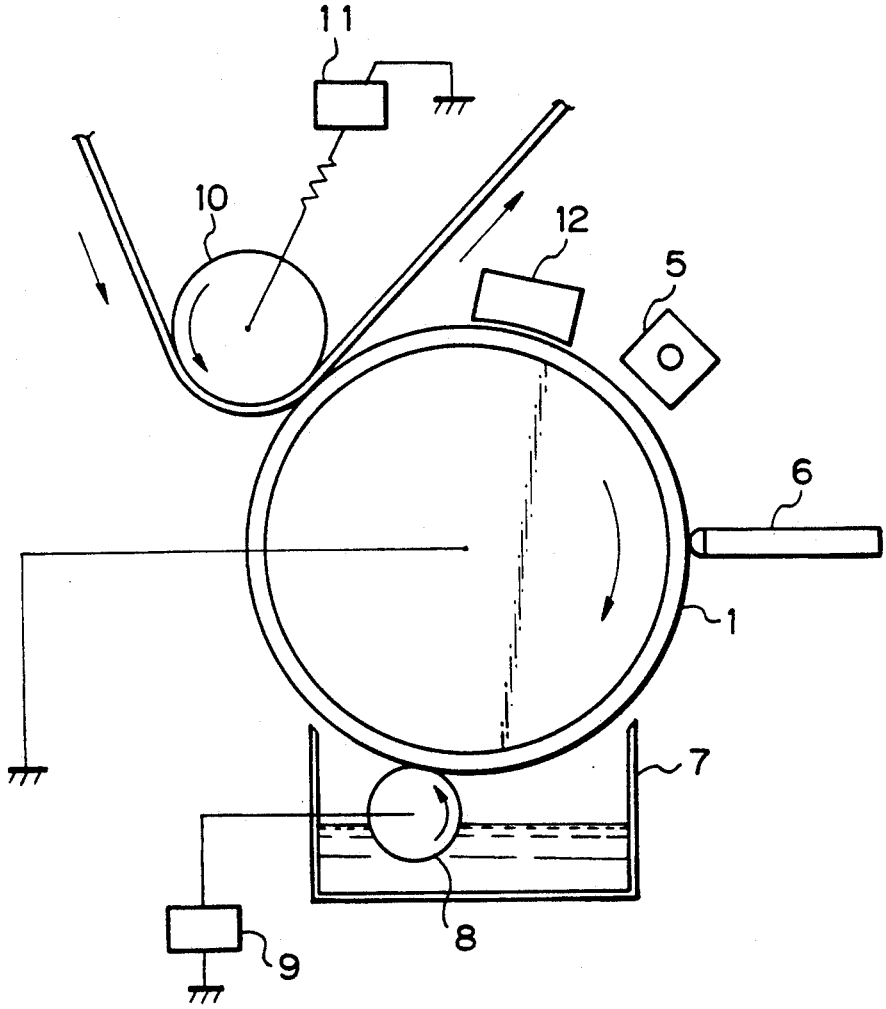

While the writing means is shown as contacting the near of the dielectric body in the form of a belt, the former may alternatively contact the front of the latter. The belt may be replaced with a drum, as shown in FIG. 18. In FIG. 18, the same or similar parts and elements as those of the above-described embodiment are designated by like reference numerals. The charger 5 serving as charging means may be replaced with a charging roller or a charging blade. Because the image carrier is dielectric and, therefore, readily deposits a charge by friction, use can be made of an inexpensive frictional charging member. The line type thermal print head 6 is only illustrative and may be replaced with a shuttle type thermal print head. The developing device using a liquid developer may be replaced with a developing device operable with a one- or two-component type dry developer or even with a developing device operable with a toner which is to be fixed by pressure. The embodiment using a liquid type developing device is operable with a low fixing temperature, compared to a dry developer type developing device, so that image transfer and fixation can be performed at the same time while reducing the thermal deterioration of the dielectric body. Nevertheless, even when the dry developer type developing device is used, the simultaneous image transfer and fixation is achievable if use is made of a dielectric body which does not deteriorate at the temperature for fixing a toner. If desired, a fixing unit may be provided independently of the image transfer station, in which case a paper sheet separated from the image carrier after image transfer will be passed through the fixing unit. When a toner which fixes under pressure is used, a pressurizing mechanism will be substituted for the heating lamp.

Figure 19:
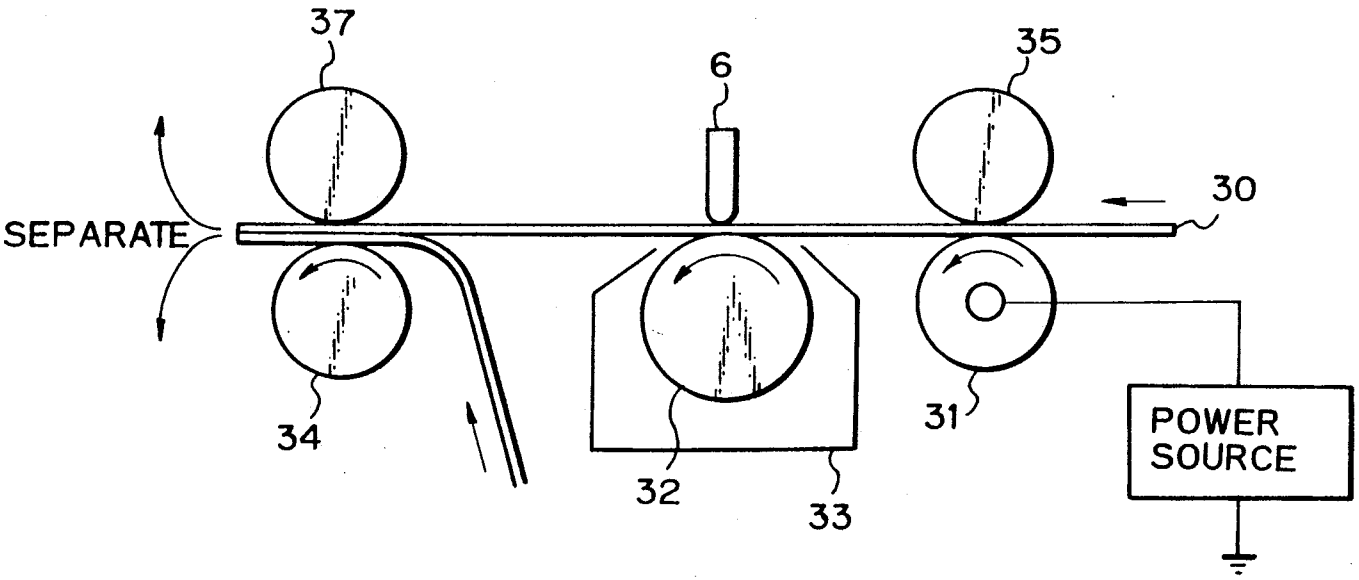

FIG. 19 shows an alternative embodiment of the present invention which uses a dielectric image carrier only once for image formation as in the process shown in FIG. 2. As shown, a dielectric sheet, or image carrier, 30 defines a paper transport path. A roller and charging roller 31, a developing device 33 having a toner roller, and a fixing roller 34 are sequentially arranged in this order from the upstream side of the dielectric sheet 30 with respect to the intended direction of paper feed. A transport roller 35, the thermal print heat 6 and a pressure roller 37 are disposed above the transport path and face the roller and charging roller 31, toner roller 32, and fixing roller 34, respectively. A device for manually inserting the dielectric sheet 30 and a device for manually inserting a paper sheet, not shown, are also incorporated in the equipment.

In the above construction, the dielectric sheet 30 is inserted by hand as far as a position close to the position where the transport roller 35 and roller and charging roller 31 are in contact and then transported to the above-mentioned position by transporting means which is included in the manual insertion device, not shown. Then, the charging roller 31 charges the dielectric sheet 30. The charged dielectric sheet 30 is driven between the thermal print head 6 and the toner roller 32 by the above-mentioned transporting means and the cooperating rollers 35 and 31. As a result the formation of a latent image and the development thereof are effected at the same time. A paper fed from the manual insertion device, not shown, is brought into register with the lower surface of the dielectric sheet 30 carrying the developed image and being transported toward the fixing roller 34 and pressure roller 37 which are held in contact with each other. As the dielectric sheet 30 and paper sheet move between the rollers 34 and 37 together, the developed image is transferred from the sheet 30 to the paper sheet and fixed on the latter at the same time. The sheet 30 and the paper sheet driven out of the equipment are separated from each other by hand.

This embodiment causes the operator to insert a dielectric sheet and a paper sheet and to separate them from each other every time the equipment performs a printing operation, eliminating the need for devices for automatically feeding the sheet 30 and paper sheet. The embodiment is, therefore, operable without rollers, solenoids for roller drive control, gears and other similar mechanical parts, cutting down the cost. Although the manual operations which the operator has to perform to form images and the cost are contradictory to each other, the embodiment realizes a wide variety of equipment from a cost standpoint because the equipment can be constituted by the same kind of image carriers. Such equipment having many common parts are successful in enhancing productivity.

Referring to FIGS. 20–23B, another alternative embodiment of the present invention will be described. This embodiment is selectively operable in either of two different modes, i.e., a sheet mode in which a dielectric image carrier is driven out of the equipment as the final toner image carrier, and a paper mode in which a toner image is transferred from the dielectric image carrier to a paper sheet or similar recording medium and, thereafter, the paper sheet is driven out as the final toner image carrier.

Figure 20:
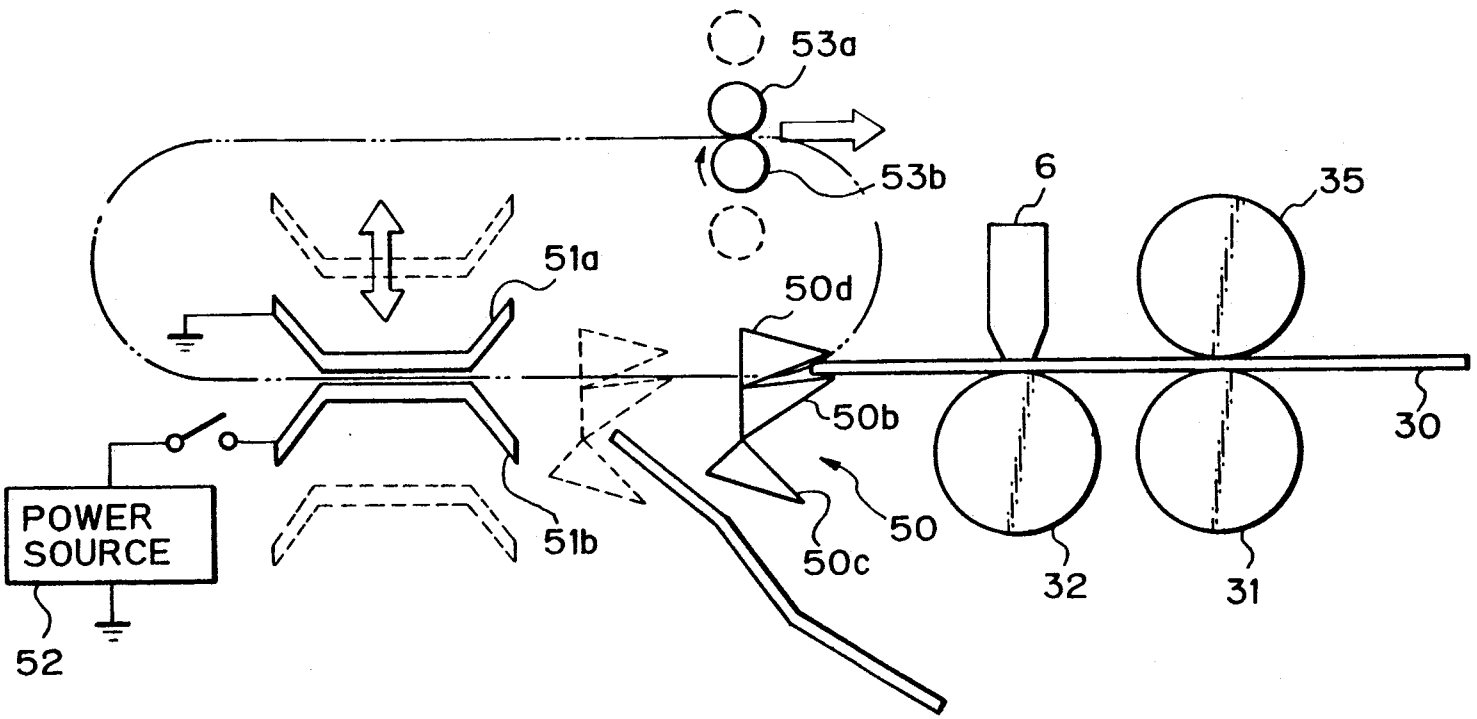

As shown in FIG. 20, the transport roller 35, 31 and the developing device having the toner roller 32 are arranged in this order from the upstream side of the transport direction of the dielectric sheet 30 and below the transport path, as in the embodiment of FIG. 19. The transport roller 35 and thermal head 6 face the rollers 31 and 32, respectively. The transport roller 35 and print head 6 are each movable between an operative position shown in FIG. 20 and an inoperative position spaced apart from the transport path. A roller cover member 54 also selectively assumes either of two different positions, i.e., a position where it faces the toner roller 32 from the right-hand side, as indicated by a phantom line in FIG. 21, and a position where it faces the toner roller 32 from above the latter, as indicated by a solid line in the figure. A fixing device comprises an upper and a lower heat plate 51*a* and 51*b* which face each other at the intermediary of the transport path and are movable toward and away from each other. The heat plates 51*a* and 51*b* each has a conventional heating mechanism and heats to a predetermined temperature. The upper heat plate 51*a* is connected to ground while the lower heat plate 51*b* is connected to a power source 52 to be applied with a voltage for generating an electric field for image transfer. If desired, the heat plates 51*a* and 51*b* may be replaced with a pair of heat rollers which are also movable toward and away from each other. An upper and a lower discharge roller 53*a* and 53*b* are also movable toward and away from each other and constitute a discharging section for driving a paper sheet with or without the dielectric sheet 30 out of the equipment.

Figure 23A:
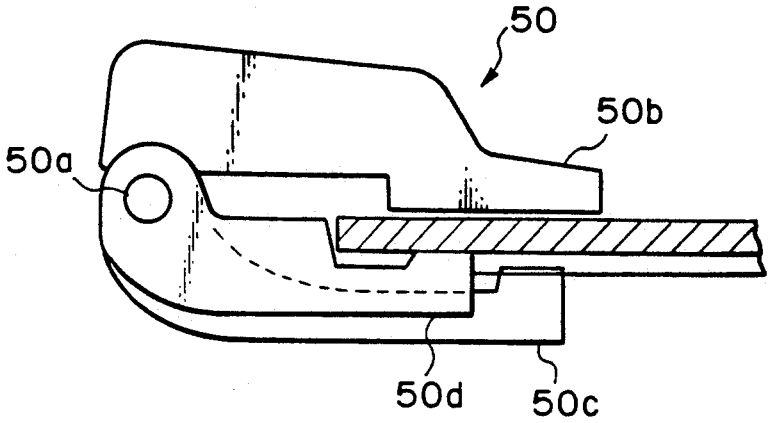
FIGS. 23A and 23B are respectively a front view and a perspective view of a clamper included in the equipment of FIG. 21.
Figure 23B:
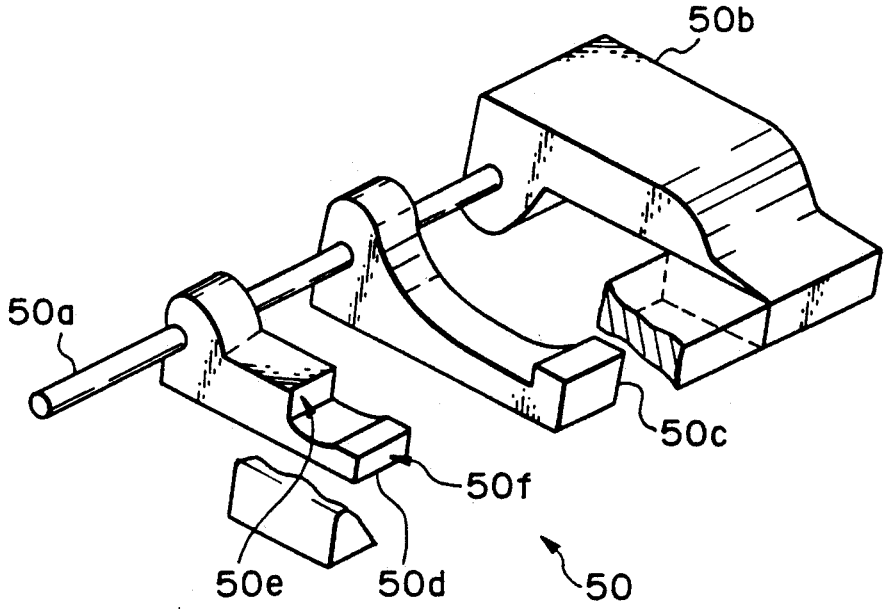

A clamper 50 is affixed to, for example, a plastic chain pair, not shown, which is movable along a circulation path. The circulation path extends from a clamp start position defined between the image forming and developing station, where the head 6 and toner roller 32 are located, and the inlet of the fixing device back to the clamp start position via the gap between the heat plates 51*a* and 51*b* and the gap between the discharge rollers 53*a* and 53*b*. In the clamp start position, the clamper 50 assumes a position indicated by a solid line in FIG. 20. Hence, the clamper 50 is movable along the circulation path while clamping the leading edge of the dielectric sheet 30 and a paper sheet. As shown in FIGS. 23A and 23B, the clamper 50 has a shaft 50*a* affixed to the plastic chain pair at opposite ends thereof, an upper pawl 50*b* mounted on the shaft 50*a*, a first lower pawl 50*c* for clamping the leading edge of a paper sheet in cooperation with the upper pawl 50*b*, and a second lower pawl 50*d* for clamping the leading edge of the dielectric sheet 30 in cooperation with the upper pawl 50*b*. The upper pawl 50*b* has an elongate flat clamp portion extending parallel to the shaft 50*a*. The lower pawls 50*c* and 50*d* are mounted on the shaft 50*a* at spaced positions from each other, and each has a clamp surface that faces the underside of the elongate clamp portion of the upper pawl 50*b*. The lower pawl 50*d* is shorter than the lower pawl 50*c*, as measured from shaft 50*a* to the free end of the pawl. The vertical end face of the lower pawl 50*d* forms an abutment 50*f* against which the leading edge of a paper sheet is to abut. A vertical abutment 50*e* is also formed on the lower pawl 50*d* between the abutment 50*f* and the shaft 50*a*, so that the leading edge of the dielectric sheet 30 may make contact with abutment 50*e*. A clamp control mechanism, not shown, is associated with the pawls 50*b*, 50*c* and 50*d* to move each of them to either of a clamping position and an unclamping position. The upper and lower heat plates 51*a* and 51*b* and the upper and lower discharge rollers 53*a* and 53*b* may each be moved toward and away from each other by an exclusive position control mechanism. Alternatively, contact members may be mounted on opposite ends of the shaft 50*a* and held in contact with the heat plates 51*a* and 51*b* and the shafts of the discharge rollers 53*a* and 53*b*. Then, the contact members will move the plates 52*a* and 52*b* and the rollers 53*a* and 53*b* toward and away from each other in interlocked relation to the movement of the clamper 50.

A device for allowing the dielectric sheet 30 to be inserted by hand and a device for implementing the automatic or manual insertion of a paper sheet, not shown, are also incorporated in the equipment. A toner to be deposited on the toner roller 32 for development is of the kind which softens at the time of fixing at a temperature lower than the thermal deformation temperature of the dielectric sheet 30.

Figure 22:
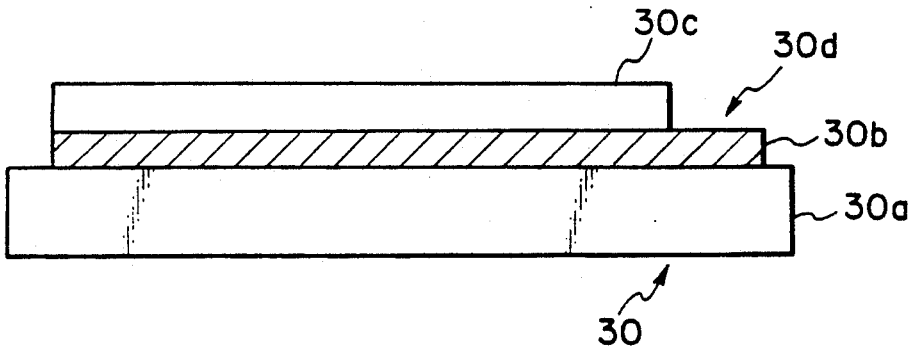
FIG. 22 is a section of a dielectric sheet appicable to the equipment shown in FIG. 21.

In the illustrative embodiment, the dielectric sheet 30 may be implemented as a laminate of a dielectric layer 30*a*, a conductive layer 30*b*, and a protective layer 30*c*, as shown in FIG. 22. The conductive layer 30*b* may be formed on the dielectric layer 30*c* by the evaporation of aluminum or may be constituted by a transparent conductive material. The protective layer 30*c* prevents the conductive layer 30*b* from being damaged or from coming off. The protective layer 30*c* is absent at, for example, the right edge portion of the dielectric sheet 30 with respect to the transport direction and throughout the length with respect to the same direction, i.e., the conductive layer 30*b* is exposed to the outside along such an edge portion to form an exposed portion 30*d*. An electrode member, not shown, disposed in the equipment contacts the exposed portion 30*d* of the dielectric sheet 30 to selectively connect the conductive layer 30*b* to ground or to apply a predetermined voltage thereto. In the embodiment, the side edge of the conductive layer 30*b* is located closer to the center than the side edge of the dielectric layer 30*a*, preventing the leak via the side edge of the dielectric sheet 1 effectively. The dielectric sheet 30 is cut in the size of A4, for example, and inserted into the equipment by hand with the protective layer 30*c* facing upward. To insure the insertion of the dielectric sheet 30 in such a position, a particular mark may be provided on a particular surface of the sheet 30 and sensed by a sensor mounted on the clamper 50 or the charging roller 31. Alternatively, contact terminals may be provided on the clamper 50 and the transport roller 31 in such a position that they are engageable with the exposed portion 30*d* of the sheet 30. In such a case, the position in which the sheet 30 is inserted will be determined on the basis of the conduction of the contact terminals.

In the sheet mode wherein the dielectric sheet 30 itself will constitute the final toner image carrier, the whiteness of the dielectric sheet 30 should preferably be relatively high. For this purpose, a white bed may be used as the dielectric substance of the dielectric layer 30*a*. When the dielectric layer 30*a* is made of a transparent dielectric substance as stated earlier, the conductive layer 30*b* may also be formed of a transparent conductive substance, in which case the protective layer 30*c* should be white. Because the sheet 30 is heated by the print head 6, both the dielectric layer 30*a* and the protective layer 30*c* should preferably be formed of substances which do not deform when heated during writing. Should a difference in thermal expansion or thermal contraction be developed between the dielectric layer 30*a* and the protective layer by the print head or the heat plate pair 51*a* and 51*b*, the sheet 30 would curl. In light of this, the heating temperatures of the print head 6 and heat plate pair 50*a* and 50*b* should be so controlled as to prevent the layers of the laminate from deforming due to heat. Preferably, the dielectric layer 30*a* and protective layer 30*c* are made of substances whose thermal characteristics are relatively close to each other or made of the same substance.

In the illustrative embodiment, a mode switch control section selects either the sheet mode for discharging the dielectric sheet 30 as the final toner image carrier or the paper mode for discharging a paper sheet carrying a toner image transferred thereto from the sheet 30 as the final toner image carrier, in response to a signal from a mode switch provided on an operation board or to a signal from a sensor in response to a paper sheet. A drive signal control section is responsive to a control signal from the mode control section for selectively delivering to the print head 6 a signal which forms a latent image on the sheet 30 in an ordinary position or a signal which forms it as a mirror image. The mode switch control section and drive signal control section are built in a main controller which includes a CPU.

The operation of the illustrative embodiment will be described hereinafter.

Figure 21:
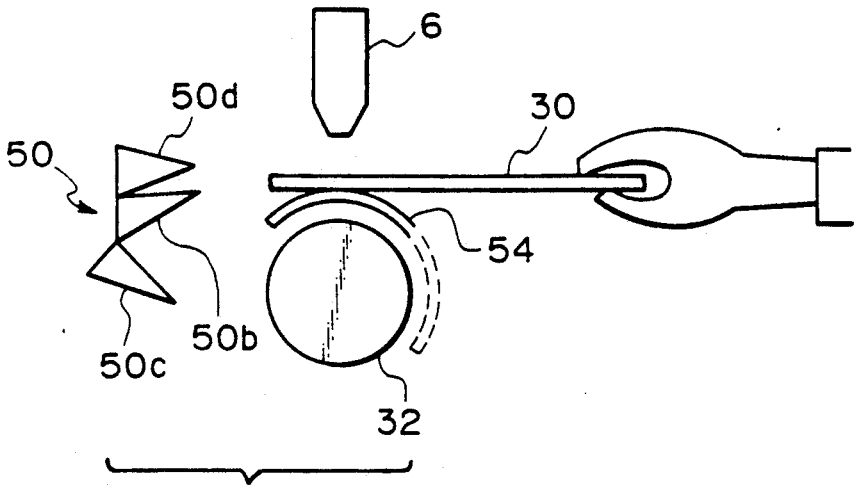
FIG. 21 shows how a dielectric sheet is inserted into the equipment shown in FIG. 20.

In a standby condition, the clamper 50 is held in a clamp start position, i.e., the upper pawl 50*b* and the lower pawls 50*c* and 50*d* are spaced apart from each other. The transport roller 35 and print head 6 are retracted away from and above the transport path. The roller cover 54 is disposed above the toner roller 32. As shown in FIG. 21, when the operator inserts the dielectric sheet 30 into the equipment until the leading end of the sheet 30 reaches the gap between the upper pawl 50*b* and the lower pawl 50*d*, the pawls 50*b* and 50*d* are closed to hold the leading end of the sheet 30. While the manual insertion is under way, the position of the sheet 30 is sensed and, if necessary, an alarm means is driven. On the start of an image forming operation, the clamper 50 clamping the sheet 30 is moved along the transport path. When the part of the sheet 30 having been charged by the charging roller 31 arrives at the toner roller 32, the roller cover 54 is rotated to the position where it faces the right-hand side of the roller 32, causing the roller 32 to start contacting the lower surface of the sheet 30. At the position where the toner roller 32 contacts the sheet 30, the print head 6 writes a latent image on the rear of the sheet 30 while, at same time, the toner deposited on the toner roller 32 develops the latent image. The latent image is in an ordinary position in the sheet mode or in a reversed position in the paper mode. In the sheet mode, at the time when the clamper 50 has reached a paper clamp start position (indicated by a phantom line in FIG. 20) closer to the fixing device than the previously mentioned sheet clamp start position, the leading edge of a paper sheet fed from the paper feeding device arrives at the gap between the upper pawl 50*b* and the lower pawl 50*c*. Then, the pawls 50*b* and 50*d* are closed to nip the leading edge of the paper sheet. In the sheet mode, the pawls 50*b* and 50*d* are closed without a paper sheet being fed thereto.

The clamper 50 is further advanced to enter the gap between the upper and lower heat plates 51*a* and 51*b* which are spaced apart from each other at this stage of operation, as indicated by phantom lines in FIG. 20. After the clamper 50 has moved away from the heat plates 51*a* and 51*b*, the heat plates 51*a* and 51*b* are move toward each other. Then, in the paper mode, a predetermined voltage assigned to a paper sheet is applied from the power source 52 to the lower heat plate 51*b*. As a result, an electric field is developed between the heat plates 51*a* and 51*b* to transfer the toner efficiently from the sheet 30 to the paper sheet, especially at the neighborhood of the inlet of the heat plates 51*a* and 51*b*. On the other hand, in the sheet mode, no voltage is applied to the lower heat plate 51*b*. The heat plates 51*a* and 51*b* which are moved toward each other define a gap therebetween which is selected to be greater than the thickness of the sheet 30 and smaller than the total thickness of the sheet 30 and paper sheet. In this configuration, in the paper mode, the toner is transferred to and fixed on the paper sheet with the sheet 30 and paper sheet being lightly pressed by the heat plates 51*a* and 51*b*. In the sheet mode, the sheet 30 is transported with side edges thereof held by, for example, spacer rollers, so that the toner image formed on the underside of the sheet may not contact the lower heat plate 51*b*. The clamper 50 having moved away from the heat plates 51*a* and 51*b* makes a turn along the transport path and then enters the gap between the discharge rollers 53*a* and 53*b* which are spaced apart from each other at this stage of operation. On moving away from the rollers 53*a* and 53*b*, the clamper 50 is caused to move the pawl 50*b* and the pawls 50*c* and 50*d* away from each other, releasing the sheet 30 with or without the paper sheet accompanying it. Then, the clamper 50 returns to the sheet clamp position and stops there. The sheet 30 and paper sheet or only the sheet 30 released from the clamper 50 is driven to the outside by the discharge rollers 53*a* and 53*b* which have been moved toward each other. This completes the image forming operation.

The dielectric sheet 30 and paper sheet driven out of the equipment in the paper mode are in close adhesion to each other because the toner melted in between the heat plates 51*a* and 51*b* is cooled off. The operator separates the dielectric sheet 30 and paper sheet by hand. At this instant, the toner remains fast on the paper sheet being peeled off from the dielectric sheet 30, because the separability of the sheet 30 and toner is higher than that of the paper sheet and toner. In the sheet mode, the dielectric sheet 30 discharged to the outside of the equipment carries the toner having been cooled off and is used as the final toner image carrier. In both the paper mode and the sheet mode, it is desirable to reuse the dielectric sheet 30 to promote effective use of limited resources. For this purpose, a dielectric sheet cleaning device is prepared independently of the image forming equipment and used to remove the toner remaining on or adhered to the dielectric sheet 30. The dielectric sheet cleaning device may incorporate a blade made of metal, ceramic or similar rigid material and having a sharp edge, and a fur brush or a web brush. In this type of cleaning device, after the blade has scraped off the toner from the dielectric sheet 30, the fur brush or the web brush further cleans the surface of the sheet 30.

The toner adhered to the dielectric sheet 30 has relatively high separability, as stated above. Regarding the reuse of the sheet 30, it can be cleaned more easily when the toner remains on the sheet 30 in the form of particles than when it is fully melted. Preferably, therefore, the fixing conditions of equipment should be so selected as to fix a toner image in such a state. Among them, the pressure to be exerted by the heat plates 51*a* and 51*b* should preferably be relatively low.

Hereinafter will be described the control over the drive of the thermal print head 6 or similar thermal writing means incorporated in image forming equipment of the type described. Let the thermal writing means be represented by the print head 6.

A dielectric body which is repetitively usable as an image carrier as stated above should have a thermal deformation temperature higher than the thermal writing temperature. Especially, it is preferable that the temperature Tsv of the dielectric body at which the target potential Sv of an image portion is achievable and the thermal deformation temperature Ttr greatly differ from each other. Regarding the potential attenuation shown in FIG. 13, how a potential attenuates at temperatures higher than the potential attenuation start temperature Ts and ascribable to the print head 6 is dependent on the charge potential in the charge portion of the dielectric body, the thickness of the dielectric body, the temperature elevation rate by the print head 6, etc. In FIG. 13, the extension a of the substantially linear portion of the potential attenuation curve and the horizontal line b corresponding to the charge potential in the charged portion intersect each other. Examining the temperature Ts-sv corresponding to the point of intersection of the lines a and b (referred to as a potential attenuation variation point temperature hereinafter) is useful in determining the characteristic value indicative of a difference in the manner of potential attenuation. Specifically, examining the potential attenuation variation point temperature Ts-sv is useful when a dielectric body suitable for the target potential SV and the drive condition of the print head 6 which have been determined on the basis of the other conditions should be selected, or when the drive condition of the thermal print head 6 should be determined in relation to a dielectric body and a target potential V which have been determined in advance.

Figure 24A:
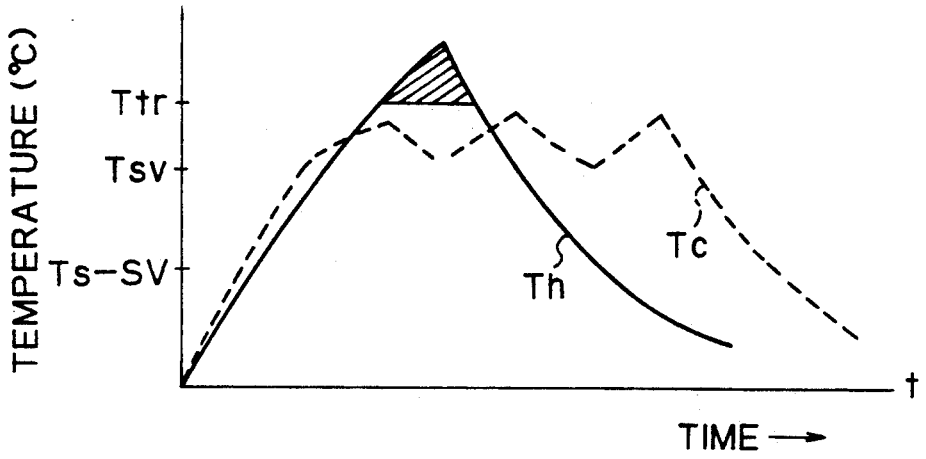
FIG. 24A is a graph showing a variation in the temperature of a thermal print head with respect to time.
Figure 24B:
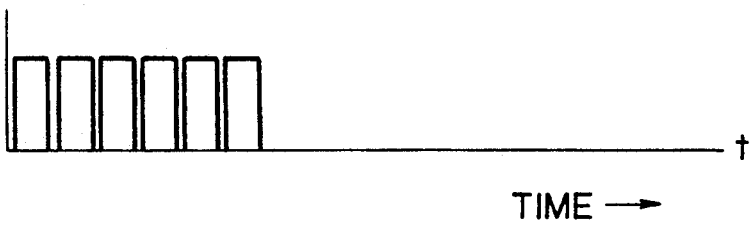
FIGS. 24B and 24C each shows specific drive voltages for driving the print head.
Figure 24C:
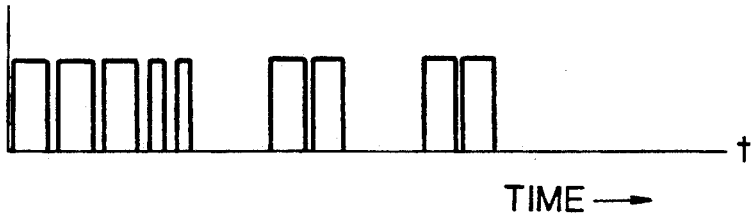

Substantially the same potential attenuation curve is sometimes obtainable even when the drive condition of the print head 6 is different. For example, the potential attenuation curve remains substantially the same when pulse voltages shown in FIG. 24B are applied to the individual elements of the print head 6 and when pulse voltages shown in FIG. 24C are applied to the same. In FIG. 24A, the ordinate and the abscissa indicate respectively the surface temperature of the print head 6 and the heating time. Th and Tc modes shown in FIG. 24A represent respectively a temperature variation caused by the pulse voltages shown in FIG. 24B and a temperature variation caused by the pulse voltage shown in FIG. 24C. The ordinate of FIG. 24A shows the previously mentioned thermal deformation temperature Ttr, the temperature Tsv matching the target potential SV, and the potential attenuation variation point temperature Ts-sv. In the Th mode, pulse voltages are continuously applied to the print head 6 to elevate the temperature at a time, the highest temperature being higher than the thermal deformation temperature Ttr. In the Tc mode, pulse voltages are continuously applied first so as to elevate the temperature at the same rate as in the Th mode, then short pulse voltages are applied so that the temperature may not exceed the thermal deformation temperature Ttr, and then the interval between the pulse voltages and the pulse width are changed to prevent the temperature from exceeding the temperature Ttr. That the potential attenuation curve remains substantially constant with no regard to the mode which causes the surface temperature of the print head 6 to vary in a particular manner stems from the fact that both the Th and Tc modes promote the migration of charge by heating the entire layer due to heat conduction in the widthwise direction of the dielectric body. In the Th mode, when the surface temperature of the print head 6 exceeds the thermal deformation temperature Ttr, as indicated by hatching in FIG. 24A, it is likely that the surface of the image carrier adjacent to the print head 6 deforms due to heat. Preferably, therefore, the print head 6 should be driven in such a condition that the highest temperature on the surface of the image carrier adjacent to the print head 6 remains above the temperature Tsv matching the target potential sv and below the thermal deformation temperature Ttr. More preferably, to reduce the writing time, the highest temperature should be close to the thermal deformation temperature within the above-mentioned range. Such drive conditions are determined by simulation, theoretical formulas and experimental expressions, and numerical operations are programmed to control the pulse voltage to be applied to the print head 6.

Figure 25:
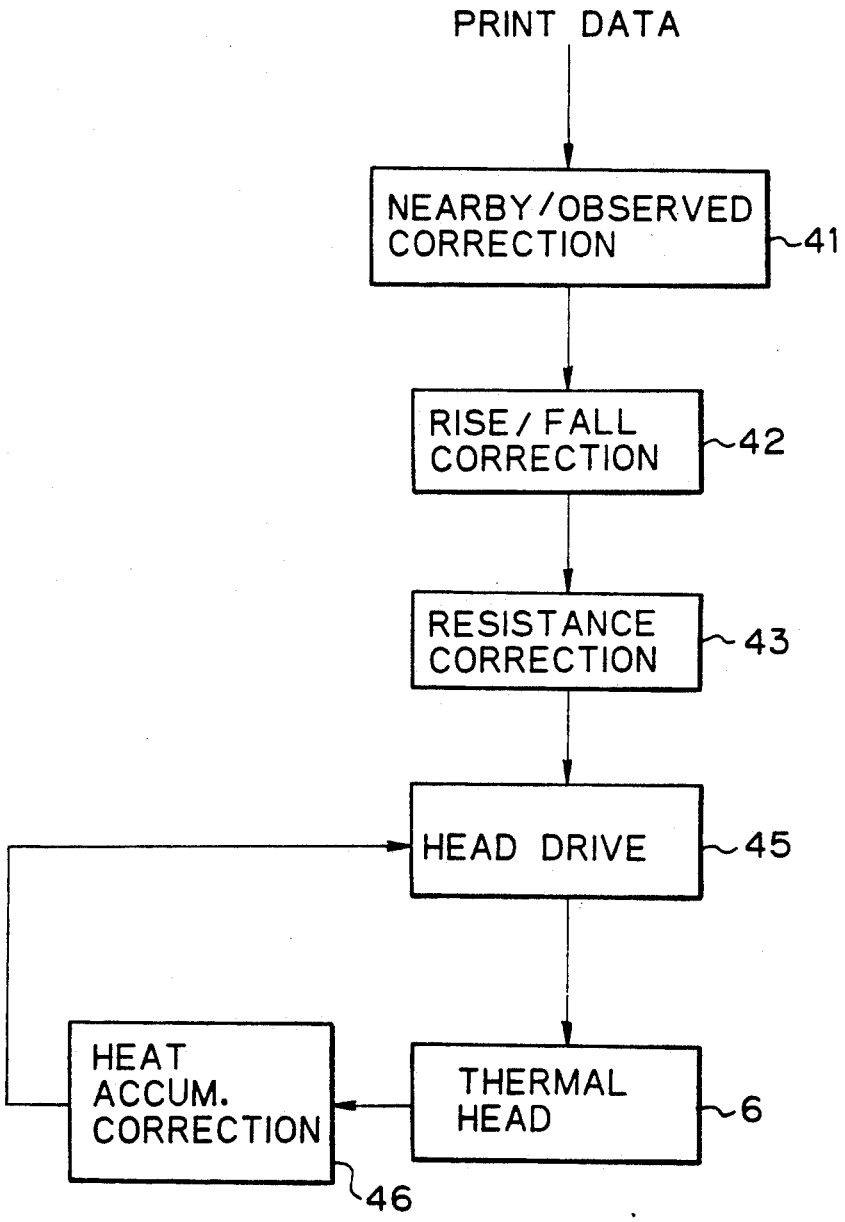
FIG. 25 is a block diagram showing a specific construction of a circuit for driving the print head.

FIG. 25 shows a specific construction of circuitry for driving the print head 6. Multilevel print data is fed from print data processing section, not shown, to a nearby/observed correcting section 41. In response, the nearby/observed correcting section 41 calculates the influence of a plurality of elements surrounding an element which should heat on the element of interest, and the influence of the pixel of interest on the pixel density due to heat having been accumulated therein over the past plurality of lines. Based on the results of calculation, the correcting section 41 corrects the print data to thereby convert it to pulse number data (the number of pulses being proportional to the density of a pixel to be printed out). A rise/fall correcting section 42 corrects the influence of heat accumulation in the substrate of the print head 6 due to the record of heating of the element of interest over the past several ten lines and the heating of several ten elements around the element of interest on the element of interest. For this purpose, the rise/fall correcting section corrects the pulse number data fed thereto from the nearby/observed correcting section 41 on the basis of the mean value of pulse number data associated with the element of interest and the surrounding elements. A resistance correcting section 43 further corrects the pulse number data from the rise/fall correcting section 42 by using the resistance data of individual elements having been measured and stored in a memory beforehand. Thereafter, a head driving section 45 converts the output data of the resistance correcting section 42 to a pulse format (pulse width, pulse number, voltage and pulse interval) suitable for the print head 6 and then transfers it to the print head 6. A heat accumulation correcting section 46 prevents heat from leaking to the substrate on which the heating elements are mounted in the event of writing. Specifically, in response to an output of a temperature sensor mounted on the substrate, the correcting section 46 suitably applies dummy pulses so that a predetermined temperature lower than, for example, the potential attenuation variation temperature is set up. When image data are to be printed line by line, it is preferably to drive the print head 6 in an odd/even drive mode. In such a mode, image data are transferred line by line to a shift register, and a latch circuit latches one line of image data. Odd dot data and even dot data constituting one line are sequentially fed out from the latch circuit to energize a block of odd elements of the print head 6 and a block of even elements.

A modified form of the latent image forming section included in the above-described type of image forming equipment will be described.

Figure 26:
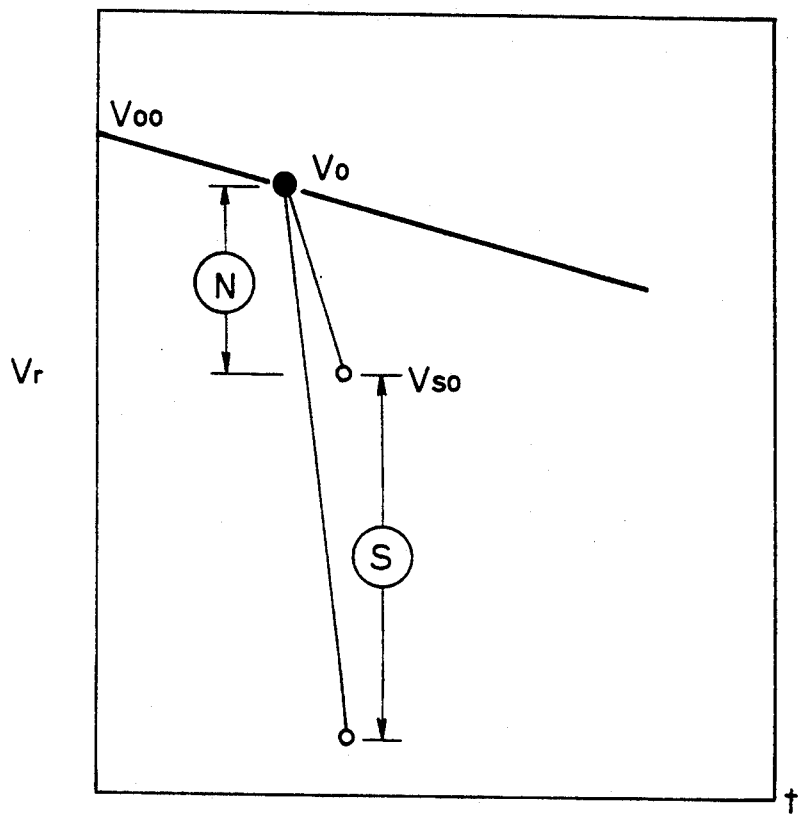
FIG. 26 is a graph showing a variation in the potential of the charged surface of an image carrier.

The latent image forming section is likely to produce a defective image, depending on the construction thereof. For example, when the print head 6 is so positioned as to contact the surface of the image carrier which has been charged by the charging section, the potential in the background becomes irregular to produce stripe-like contamination in the background of a reproduction. The irregularity in the background potential occurs for the following reason. Specifically, FIG. 26 shows a variation in the potential of a charged surface. In FIG. 26, Voo is the potential of a charged portion (initial surface potential), Vo is the surface potential before writing, scanless is the potential attenuation of an image carrier occurring when the image carrier is simply left in a natural condition, Vso (zero scan) is the potential deposited when the print head (float type) 6 contacts an image carrier in the absence of a heat signal, i.e., the background potential, and Vsa (solid image scan) is the potential deposited when a solid black image is read. Further, in FIG. 26, (Vso−Vsa) is the potential difference (SIGNAL) effective for image formation, and (vo−Vso) is the irregularity in the background potential (NOISE). The irregularity (Vo−Vso) is ascribable to the fact that when the charged surface and the print head 6 contact each other, a charge Qr corresponding to Vo of the charged surface is distributed such that the surface potentials of the charged surface and print head 6 are equal to each other. More specifically, assuming that the distributed charge is Qn, it may be approximated as:

$$(Vo-Vso)=Qn/Qh=(Qr-Qn)/Cr$$

where Ch and Cr are the electrostatic capacities of the print head 6 and image carrier, respectively.

It follows that preventing the potential from lowering from the potential Vo before writing to the potential Vso (zero scan) is effective in eliminating the above-stated defective image ascribable to the irregular background potential.

Figure 27:
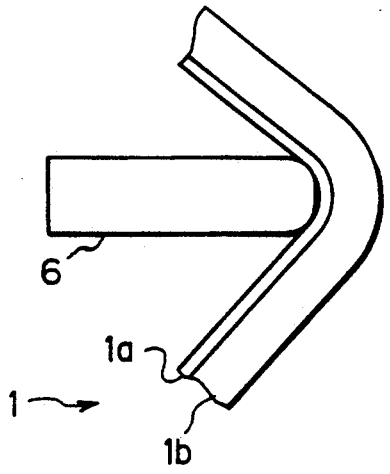
FIG. 27 shows a specific construction of a latent image forming section incorporated in image forming equipment.

A latent image forming section for implementing the above approach will be described specifically. As shown in FIG. 27, the dielectric belt 1 is made up of a conductive layer 1*a* and a dielectric layer 1*b* to be uniformly charged by a charging section, not shown. The surface of the dielectric layer 1*b* is the surface to be charged. It is to be noted that when the metallic roller 2 or metallic plate is located in the charging section at the opposite side to the charging surface of the belt 1, as shown in, for example, FIG. 17, the conductive layer 1*a* is omissible because uniform charging is insured. In FIG. 27, the print head 6 is held in contact with the side of surface of the conductive layer 1*a* opposite to the charged side of the dielectric belt 1 which is an image carrier. This is successful in preventing the potential from lowering from Vo before writing to zero scan Vso because the print head 6 does not contact the charged surface and because the print head 6 and the charge of the dielectric layer 1*b* are electrostatically screened from each other by the conductive layer 1*a*.

Figure 28A:
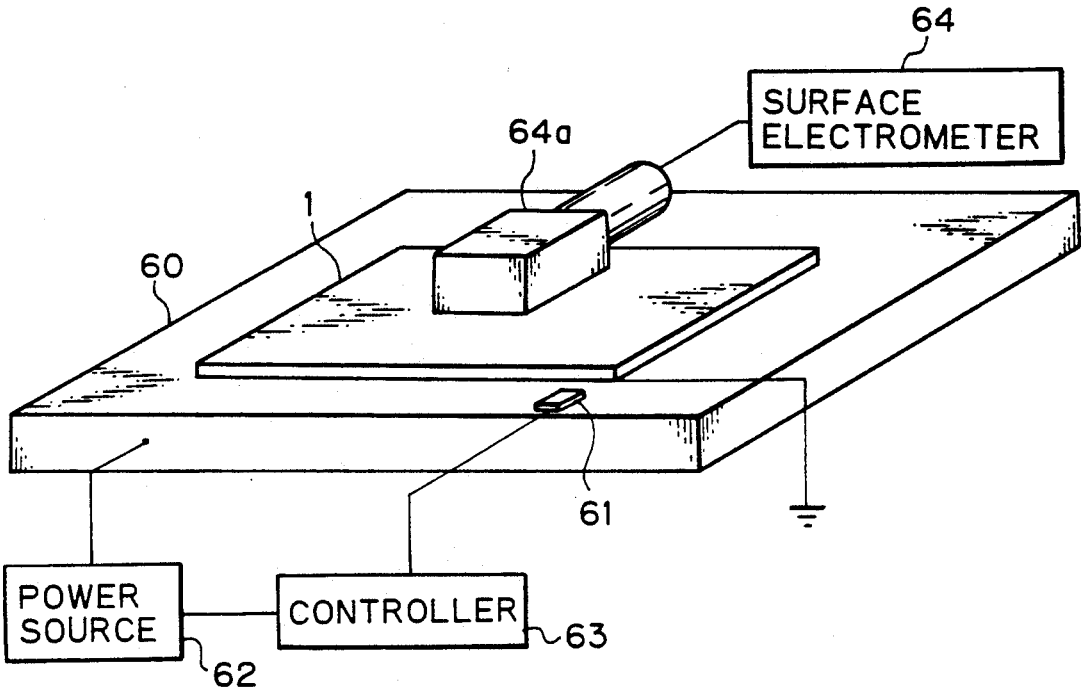
FIG. 28A shows a specific arrangement for measuring the potential attenuation of a dielectric sheet.
Figure 28B:
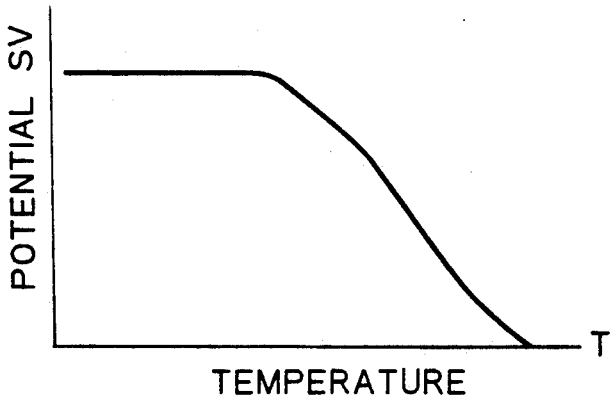
FIG. 28B is a graph showing specific results of measurement effected by the arrangement of FIG. 28A.

FIG. 28A shows a specific arrangement for proving that even when the print head 6 contacts the side of the dielectric belt 1 opposite to the charged side as stated above, potential attenuation can occur on the charged side to form a latent image. As shown, a controller 63 is responsive to the output of a temperature sensor 61 for controlling the output of a power source 62 and thereby controlling the temperature elevation rate of a heater 60. The reference numeral 64 designates an electrometer. The dielectric belt 1 consisting of the conductive layer 1*a* and dielectric layer 1*b* is cut into a sheet. The cut sheet 1 has the surface thereof charged beforehand and laid on the heater 60 with the charged surface thereof facing upward. The electrometer 64 has a detecting portion 64*a* thereof located at a predetermined distance from the charged surface of the dielectric sheet 1. The conductive layer 1*a* of the sheet 1 is connected to ground. The heater 60 is heated at a predetermined rate to in turn heat the sheet 1 while the potential attenuation on the sheet 1 due to the temperature elevation is measured by the electrometer 64. In FIG. 28, the ordinate indicates the measured potentials, and the abscissa indicates the temperatures on the sheet 1. As FIG. 28 indicates, the potential attenuates even when the sheet 1 is heated at the side thereof opposite to the charged side and a counter electrode is not disposed at the charged surface side. Further, the measurement was conducted with a plurality of dielectric sheets 1 each having a different thickness and by changing the potential of the charged surface before heating. Such measurement showed that the potential attenuation curve shown in FIG. 28B holds if the ratio of the potential Vo of the charged surface before heating (initial potential) to the thickness d of the sheet 1 is the same. In the configuration shown in FIG. 17 or 27, the end of the print head 6 contacting the dielectric belt 1 should preferably be provided with a semicircular cross-section to enhance the contact thereof with the belt 1, i.e., to reduce irregular heating.

Figure 29:
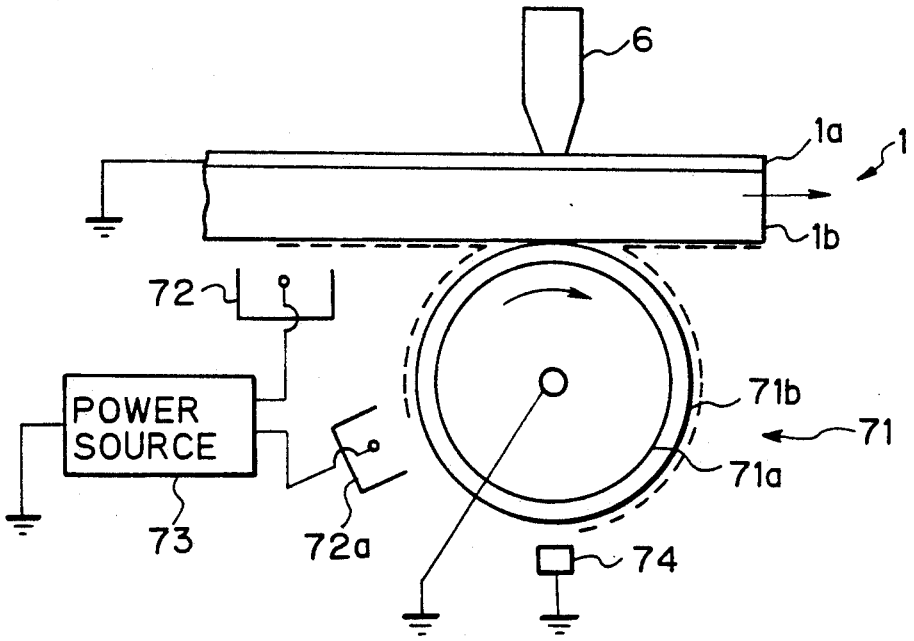
FIG. 29 shows another specific construction of the latent image forming section.
Figure 30:
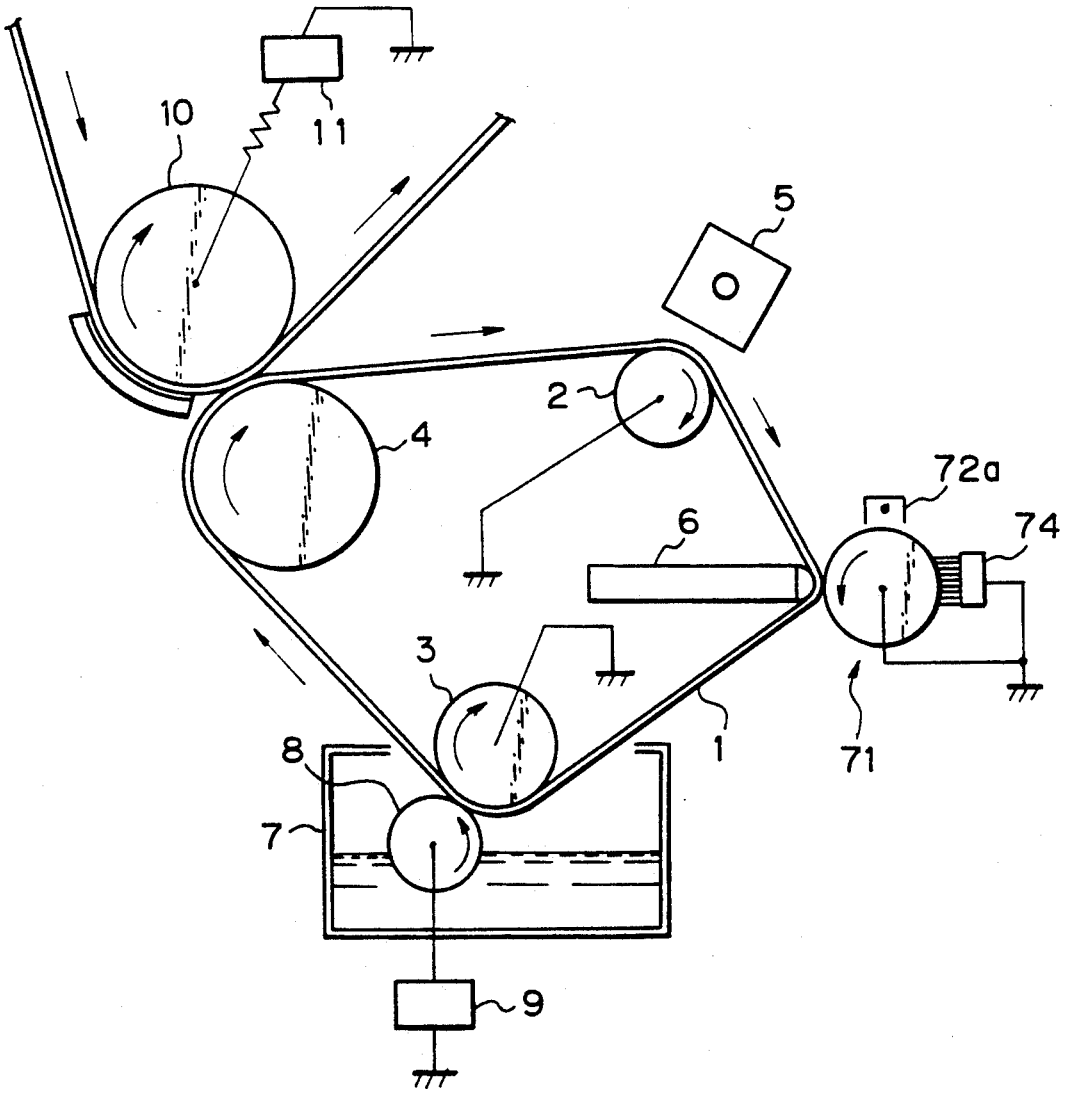
FIG. 30 shows image forming equipment using the latent image forming section shown in FIG. 29.
Figure 31A:
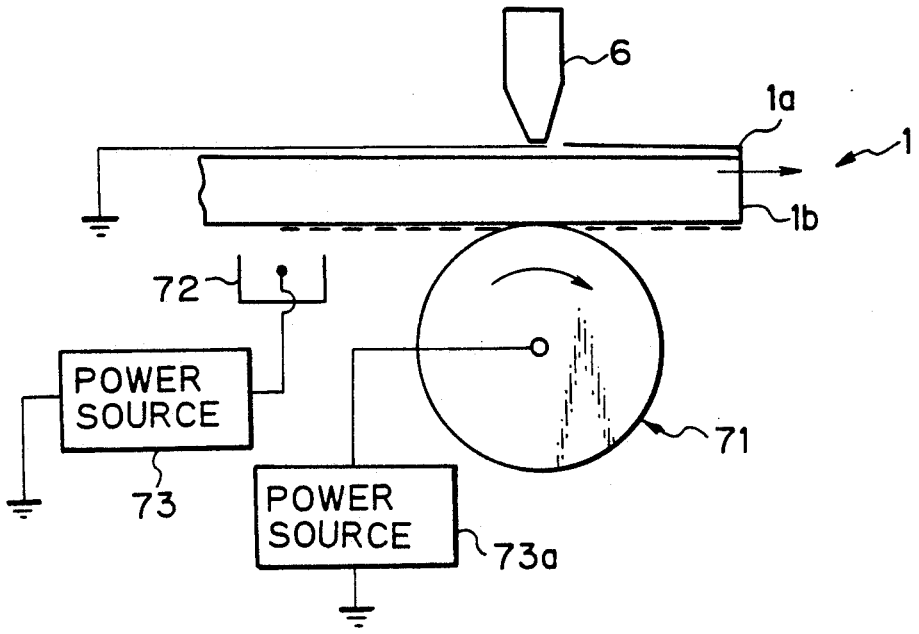
FIG. 31A shows another specific construction of the latent image forming section.

To further insure the contact of the dielectric belt 1 and the print head 6, a backup member may be held in contact with the rear of the belt 1 at the position where the print head 6 contact the belt 2. In such a case, because the backup member contacts the charged surface of the belt 1, its surface that contacts the charged surface of the belt 1 should be maintained at substantially the same potential as the charged surface in order to eliminate the previously stated fall of the potential from Vo to Vso. FIG. 29 shows a writing section including a backup member 71 for insuring the contact of the belt 1 and the print head 6, as stated above. FIG. 30 shows the backup member 71 applied to the equipment shown in FIG. 17. Further, FIG. 31A shows a modified form of the backup member.

As shown in FIG. 29, the backup member 71 is made up of a conductive roller 71*a* and a seamless dielectric body 71*b* wrapped around the roller 71*a*. The backup member 71 contacts the rear of the dielectric belt 1 at a position where the print head 6 contacts the belt 1. To insure the close contact of the print head 6 and the belt 1, the conductive roller 71*a* may be made of conductive rubber or may be implemented as a metallic roller having a conductive rubber layer thereon. The backup member 71 is rotated at the same peripheral speed as the belt 1. A corona discharger 72 is connected to a power source 73 to charge the surface of the dielectric layer 1*b* of the belt 1. Another corona discharger 72*a* is connected to the power source 73 to charge the surface of the backup member 71 to, for example, negative polarity. The print head 6 is disposed above the position where the backup member 71 contacts the charged surface of the belt 1, writing image data in contact with the surface of the conductive layer 1*a* of the belt 1. A discharging brush 74 is so located as to contact the surface of the backup member 71 having moved away from the contact portion with the charged surface of the belt 1. The brush 74 removes the charge remaining on the surface of the backup member 71 to prepare it for the next charging by the corona discharger 73. The brush 74 is only illustrative and may be replaced with a discharging roller. In the modification shown in FIG. 31A, the backup member 71 lacks the dielectric layer 71*b*, i.e., the conductive roller 71*a* plays the role of the backup member 71.

A power source 73*a* applies a voltage to the conductive roller 71*a* to maintain the potential thereof substantially the same as the potential of the charged surface of the belt 1.

In any of the specific configurations described above, the backup member 71 backs up the belt 1 from the rear at the position where the print head 6 contacts the belt, insuring the contact of the print head 6 and belt 1. Because the surface of the backup member 71 contacting the charged surface of the belt 1 has substantially the same potential as the charged surface of the belt 1, the potential is prevented from lowering from Vo to Vso due to the distribution of the charge potential of the belt 1.

Figure 31B:
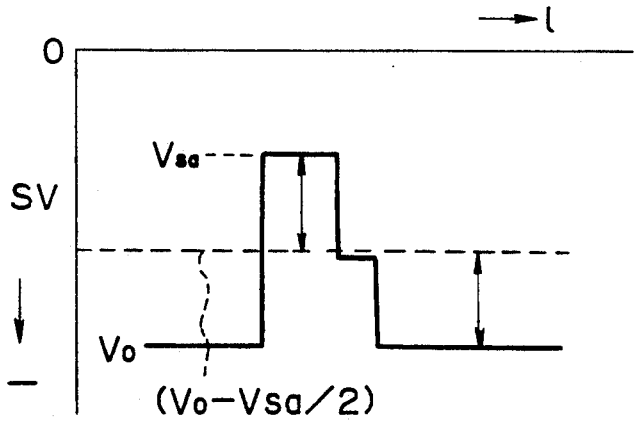
FIG. 31B shows a voltage to be applied to a backup member included in the construction of FIG. 31A.

To eliminate the Paschen's discharge, the potential difference between the charged surface of the dielectric belt 1 and the backup member 71 should preferably be lower than 500 volts. In the specific arrangement shown in FIG. 31A, the Paschen's discharge should be prevented from occurring between the surface portion of the belt 1 where the potential has lowered to the target potential Vsa by the print head 6 and the surface of the backup member 71. For this purpose, as shown in FIG. 31B, the voltage to be applied from the power source 73*a* is so selected as to set up, for example, a potential intermediate between the initial charge potential Vo and the target potential Vsa. Then, a potential difference which does not cause the Paschen's discharge to occur is set up between the backup member 71 and the target potential portion and between the member 71 and the initial charge potential portion, because the absolute value of the initial charge voltage Vo is usually about 1000 volts.

Figure 32A:
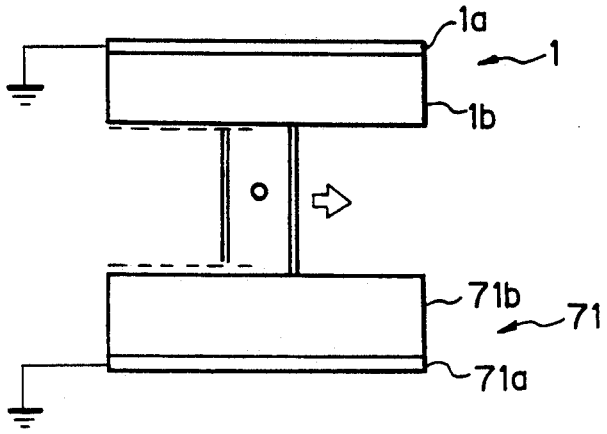
FIGS. 32A–32C show a principle particular to the construction of FIG. 29.
Figure 32B:
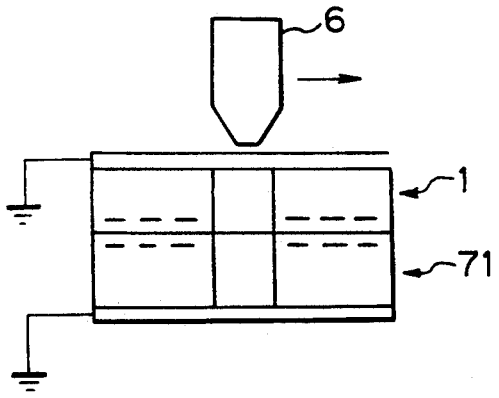
Figure 32C:
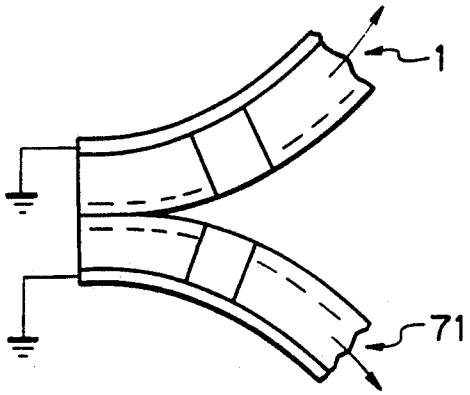

On the other hand, in the configuration shown in FIG. 29, the dielectric layer 71*b* forming the surface of the backup member 71 is successful in effectively eliminating the Paschen's discharge between opposite surfaces. This will be described with reference to FIGS. 32A-32C more specifically. As shown in FIG. 32A, substantially the same charge is deposited on the image carrier 1 and backup member 71. Then, the print head 6 partly heats in response to print data to form a latent image on the image carrier 1 while the image carrier 1 and backup member 71 have their charged surfaces held in close contact with each other, as shown in FIG. 32B. As a result, the potential lowers in the portion of the belt 1 which is heated by the print head 6. Besides, the portion of the dielectric layer 71*b* contacting the portion of the belt 1 being heated by the print head 6 is heated via the belt 1 and, therefore, has the potential thereof lowered. Then, the charges on the charged surfaces of the belt 1 and dielectric layer 71*b* become easy to move and thereby lower the potential. How the potential attenuates is dependent on the substance of the image carrier 1 and that of the backup member 71 and the heating temperature and heating time of the print head 6. Thereafter, as shown in FIG. 32C, the image carrier 1 and the backup member 71 are separated from each other. Then, the image carrier 1 is sequentially transported through the developing, transferring and, if necessary, cleaning and initializing stations and returned to the state shown in FIG. 32A.

Figure 33:
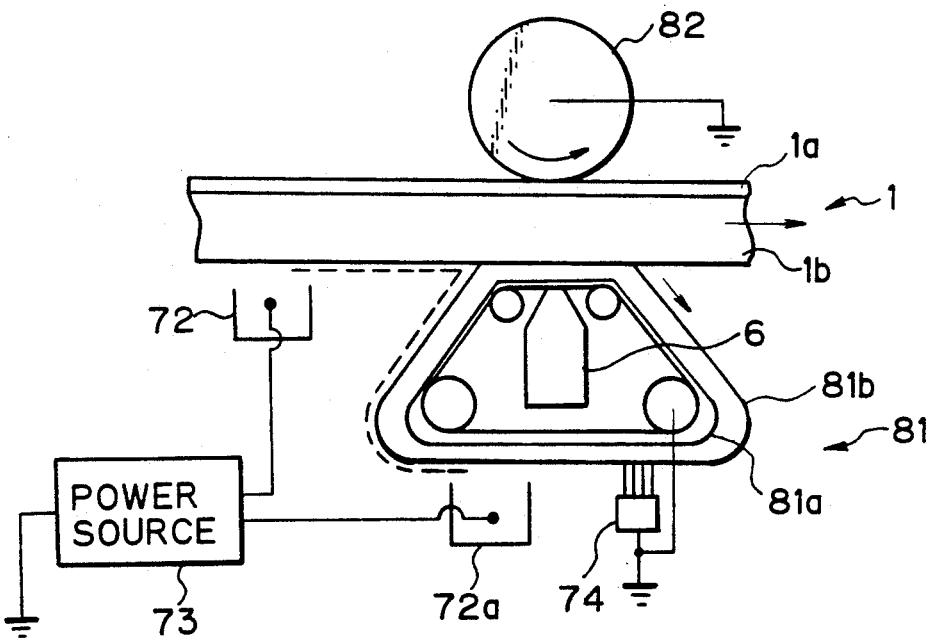
FIG. 33 shows another specific construction of the latent image forming section.

Referring to FIG. 33, another specific construction for preventing the potential from falling from the surface potential Vo before writing to the zero scan potential Vso. The construction of FIG. 33 is applicable to equipment of the type having the print head 6 on the charged surface side of the dielectric belt 1 and is desirable when such a position of the print head 6 is indispensable for layout and other similar reasons. As shown, an intermediate belt member 81 is passed over a plurality of pulleys and partly held in contact with the surface of the dielectric layer 1*b* of the belt 1 which is the charged surface. The intermediate belt member 81 is made up of a conductive layer 81*a* and a dielectric layer 81*b* formed on the conductive layer 81*a*. The print head 6 is disposed in the space defined by the belt member 81 and has the tip or heating section thereof held in contact with the rear of belt member 81 at a position where the belt member 81 contacts the dielectric belt 1. This specific construction also includes the corona discharger 72*a* and discharging brush 74. A press roller 82 is connected to ground and contacts the rear of the portion of the belt 1 which contacts the belt member 81, playing the role of a backup member.

In the construction shown in FIG. 33, while the print head 6, intermediate belt member 81 and dielectric belt 1 are held in close contact, the print head 6 heats the belt 1 via the belt member 8 to write a latent image thereon. At this instant, the print head 6 and the charge on the dielectric layer 1*b* are electrostatically screened by the conductive layer 81*a*, and the surface potential of the dielectric layer 81*b* of the belt member 81 which contacts the charged surface of the belt 1 is maintained at substantially the same potential as the charged surface of the belt. Such a condition successfully prevents the potential from lowering from Vo to Vso. Moreover, regarding the principle shown in FIGS. 32A–32C, the print head 6 contacts the surface of the conductive layer 71*a* which is opposite to the charged surface of the backup member 71 and does not contact the surface of the conductive layer 1*a* which is opposite to the charged surface of the image carrier. Therefore, both the charged surfaces of the belts 1 and 81 undergo potential attenuation, effectively eliminating the Paschen's discharge. In addition, the press roller 82 backing up the belt 1 insures the close contact of the belts 1 and 81.

In the specific construction shown in FIGS. 29 or 33, the dielectric layers 71*b* and 81*b* of the backup member 71 and intermediate belt 81 may be implemented by the same dielectric substance as the dielectric layer 1*b* of the dielectric belt 1. In FIG. 29, for the dielectric layer 71*b*, use may be made of a dielectric substance having a lower potential attenuation start temperature than the substance of the dielectric layer 1*b* of the belt 1, if such a substance does not melt against the heat propagated through the belt 1. On the other hand, in FIG. 33, the dielectric layer 81*b* may be made of a substance whose potential attenuation start temperature is higher than that of the dielectric layer 1*b* of the belt 1. In this case, the prerequisite is that the potential difference between such dielectric layers 1*b* and 81*b* does not cause the Paschen's discharge to occur. Because the intermediate belt 81 intervenes between the print head 6 and the dielectric belt 1, it should preferably be relatively thin.

Another specific construction for eliminating the potential fall from Vo to Vso is as follows.

Figure 34A:
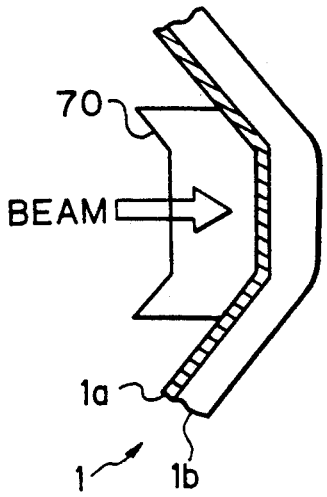
FIGS. 34A and 34B each shows another specific construction of the image forming section.
Figure 34B:
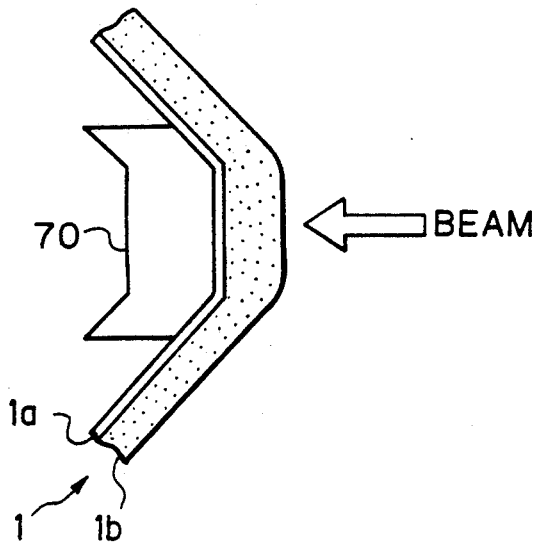

The system in which the print head 6 or similar writing means with a heating function heats an image carrier to form a latent image on the basis of potential attenuation may be replaced with a system using an image carrier having a function of heating by absorbing light. Then, when a semiconductor layer, infrared layer or similar laser not contacting the charged surface of the image carrier emits a beam toward the latter in response to print data, potential attenuation also occurs on the image carrier to form a latent image. Such an alternative system allows the laser to be spaced apart from the charged surface by a necessary distance, eliminating the potential drop from Vo to Vso. Specifically, in FIG. 34A, the conductive layer 1*a* of the dielectric belt 1 is provided with a function of heating by absorbing light, and light issuing from, for example, a semiconductor laser is incident to the conductive surface 1*a*. In FIG. 34B, the dielectric layer 1*b* of the belt 1 is formed of a dielectric substance in which particles of the kind heating by absorbing light is dispersed, and light issuing from a semiconductor laser or similar laser is incident to the dielectric layer 1*b*. Each of the constructions shown in FIGS. 34A and 34B should preferably include a backup member 70 for maintaining the portion of the belt 1 to be illuminated in a flat position. It is noteworthy that only the portion of the dielectric layer or the like having been illuminated in a concentrative manner undergoes potential attenuation due to heat, and the dielectric layer or the like is immune to light generally present in equipment which does not have any special screening structure. For this reason, the arrangements shown in FIGS. 34A and 34B, like the foregoing embodiments which use a print head or similar thermal writing means, do not need a screening structure included in a conventional equipment using a photoconductive element, enhancing the simplicity of construction.

As stated above, the embodiments shown in FIGS. 29–30, 31A and 31B and 34A and 34b each prevents the potential from dropping from Vo to Vso. This not only eliminates defective images but also allows a potential difference (SIGNAL) great enough for effective image formation to be set up and thereby frees the background of a reproduction from contamination. Moreover, the print head 6 or similar heating means does not contact the image forming surface of the dielectric belt 1 on which a toner and paper dust are apt to deposit, protecting the writing section of the heating means against mechanical damage and thereby enhancing the durability thereof.

In summary, it will be seen that the present invention achieves various unprecedented advantages, as enumerated below.

(1) In image forming equipment of the type heating a charged image carrier in association with an image to attenuate part of the potential thereof to thereby form a latent image matching the image, and developing the latent image to produce a visible image, the present invention uses a new image carrier which amplifies potential attenuation due to heat and does not rely only on the decrease in the electric resistance of an image carrier due to heat which has been customary in the art.

(2) The present invention uses a dielectric body which is less expensive than a photoconductor implementing the conventional electrophotographic system and, therefore, reduces the overall cost of the equipment.

(3) Because a latent image is formed by heat, the equipment does not need screening from light indispensable with the conventional electrophotographic system, further cutting down the cost.

(4) The image carrier is implemented by a dielectric substance having a potential attenuation start temperature higher than the ambient temperature at which the equipment is used. Hence, at the time of forming a latent image by heat, the charged image carrier holds a sufficient potential to insure stable image formation.

(5) The dielectric body has a thermal deformation temperature higher than the potential attenuation start temperature and the thermal writing temperature and, therefore, can be repetitively used a number of times.

(6) Thermal writing means for applying heat to the image carrier in association with an image is driven such that the highest temperature at the contacting surfaces of the image carrier and writing means is higher than the potential attenuation start temperature and lower than the thermal deformation temperature of the image carrier. Hence, there can be eliminated an occurrence that part of the image carrier having been deteriorated due to the thermal deformation of a dielectric layer thereof collapses, and the refuse thereof adheres to the writing means to lower the writing ability.

(8) A fixing device is so constructed as to fix the visible image on the image carrier to a particular extent such that the toner forming the image is removable from the image carrier, promoting the reuse of the image carrier.

Various modifications will become possible for those skilled in the art after receiving the teachings of the present disclosure without departing from the scope thereof.

What is claimed is:

1. Image forming equipment for applying heat to an image carrier which undergoes discharging in association with an image to attenuate part of the potential of said image carrier to thereby form a latent image on said image carrier and then developing said latent image to produce a visible image, said equipment comprising:

an image carrier;

a fixing device for fixing said visible image;

transfer medium feeding means for feeding a transfer medium to the surface of said image carrier carrying said visible image thereon while said image carrier is transported; and transporting means for driving, when the transfer medium is not fed from said transfer medium feeding means, said image carrier carrying said visible image to the outside of said equipment via said fixing device or driving, when a transfer medium is fed from said transfer medium feeding means, said transfer medium to the outside of said equipment together with said image carrier via said fixing device, said image carrier being formed of polyethylene terephthalate, or a mixture of polybutylene terephthalate and silicon dioxide, wherein said fixing device comprises a pair of conductive members facing each other at the intermediary of a transport path along which said image carrier is transported, and a power source for generating an electric field between said pair of conductive members.

* * * * *